US009159291B2

(12) United States Patent
Yamazaki et al.

(10) Patent No.: US 9,159,291 B2
(45) Date of Patent: Oct. 13, 2015

(54) LIQUID CRYSTAL DISPLAY DEVICE, METHOD FOR DRIVING THEREOF AND ELECTRONIC APPARATUS

(75) Inventors: Shunpei Yamazaki, Tokyo (JP); Jun Koyama, Kanagawa (JP); Yoshifumi Tanada, Kanagawa (JP); Mitsuaki Osame, Kanagawa (JP); Hajime Kimura, Kanagawa (JP); Ryota Fukumoto, Kanagawa (JP); Hiromi Yanai, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1080 days.

(21) Appl. No.: 11/382,408

(22) Filed: May 9, 2006

(65) Prior Publication Data

US 2006/0262066 A1 Nov. 23, 2006

(30) Foreign Application Priority Data

May 20, 2005 (JP) ..... 2005-148832

(51) Int. Cl.
*G09G 3/36* (2006.01)
*G09G 3/20* (2006.01)

(52) U.S. Cl.
CPC ..... *G09G 3/3688* (2013.01); *G09G 3/20* (2013.01); *G09G 2310/0294* (2013.01); *G09G 2320/0271* (2013.01); *G09G 2340/0428* (2013.01); *G09G 2360/144* (2013.01); *G09G 2370/08* (2013.01)

(58) Field of Classification Search
USPC ..... 345/87–104
See application file for complete search history.

(56) References Cited

U.S. PATENT DOCUMENTS

| | | | | |
|---|---|---|---|---|
| 3,838,209 | A | 9/1974 | Tsuchiya et al. | |
| 5,363,118 | A | 11/1994 | Okumura | |
| 5,523,772 | A | 6/1996 | Lee | |
| 5,705,424 | A * | 1/1998 | Zavracky et al. | 438/30 |
| 5,818,419 | A | 10/1998 | Tajima et al. | |
| 6,037,917 | A | 3/2000 | Kawakami | |

(Continued)

FOREIGN PATENT DOCUMENTS

| | | |
|---|---|---|
| EP | 1 103 946 A2 | 5/2001 |
| EP | 1 111 577 | 6/2001 |

(Continued)

OTHER PUBLICATIONS

European Search Report (European Application No. 06 007 738.5) dated May 25, 2007, 7 pages.

(Continued)

*Primary Examiner* — Sanghyuk Park
(74) *Attorney, Agent, or Firm* — Fish & Richardson P.C.

(57) ABSTRACT

The liquid crystal display device performs display by changing the number of gray scales depending on external light intensity, and switches the display mode in accordance with a content to be displayed on a display. By controlling a display mode-specific video signal generation circuit depending on external light intensity, an inputted video signal is outputted as an analog value, is outputted with a digital value of a binary, or is outputted with a multiple digital value. As a result, display gradation of a pixel changes timely. Accordingly, a clear image can be displayed. For example, a display device which secures visibility can be obtained in a wide range from under fluorescent light in a dark place or indoor to under outdoor sunlight.

12 Claims, 36 Drawing Sheets

(56) References Cited

U.S. PATENT DOCUMENTS

| | | | | |
|---|---|---|---|---|
| 6,040,812 | A | 3/2000 | Lewis | |
| 6,088,012 | A | 7/2000 | Shigeta et al. | |
| 6,229,505 | B1 | 5/2001 | Fujii | |
| 6,339,422 | B1 | 1/2002 | Kuwajima et al. | |
| 6,396,508 | B1 | 5/2002 | Noecker | |
| 6,414,661 | B1 | 7/2002 | Shen et al. | |
| 6,417,824 | B1 | 7/2002 | Tokunaga et al. | |
| 6,504,522 | B2 | 1/2003 | Shiraki et al. | |
| 6,552,736 | B2 | 4/2003 | Honda et al. | |
| 6,646,625 | B1 | 11/2003 | Shigeta et al. | |
| 6,678,834 | B1 | 1/2004 | Aihara et al. | |
| 6,693,614 | B2 | 2/2004 | Kamiya et al. | |
| 6,738,036 | B2 | 5/2004 | Janssen et al. | |
| 6,784,898 | B2 | 8/2004 | Lee et al. | |
| 6,806,859 | B1 | 10/2004 | Kanoh et al. | |
| 7,053,873 | B2 | 5/2006 | Tsutsui | |
| 7,079,107 | B2 | 7/2006 | Miyake | |
| 7,487,273 | B2 * | 2/2009 | Kobayashi | 710/62 |
| 7,515,126 | B2 * | 4/2009 | Senda et al. | 345/77 |
| 2001/0005193 | A1 * | 6/2001 | Yokoyama | 345/92 |
| 2001/0005196 | A1 | 6/2001 | Ishii | |
| 2001/0011989 | A1 | 8/2001 | Hayashi | |
| 2001/0022565 | A1 | 9/2001 | Kimura | |
| 2001/0033252 | A1 | 10/2001 | Yamazaki et al. | |
| 2002/0000969 | A1 | 1/2002 | Ozawa | |
| 2002/0011978 | A1 | 1/2002 | Yamazaki et al. | |
| 2002/0036612 | A1 * | 3/2002 | Miyajima et al. | 345/90 |
| 2002/0036613 | A1 * | 3/2002 | Yokoyama et al. | 345/92 |
| 2002/0047568 | A1 | 4/2002 | Koyama | |
| 2002/0047852 | A1 | 4/2002 | Inukai et al. | |
| 2002/0056838 | A1 | 5/2002 | Ogawa | |
| 2002/0075249 | A1 | 6/2002 | Kubota et al. | |
| 2002/0089481 | A1 * | 7/2002 | Tsutsui et al. | 345/92 |
| 2002/0109659 | A1 * | 8/2002 | Hiroki | 345/92 |
| 2002/0132454 | A1 | 9/2002 | Ohtsu et al. | |
| 2002/0154151 | A1 | 10/2002 | Koyama | |
| 2002/0158857 | A1 | 10/2002 | Iisaka | |
| 2002/0163591 | A1 | 11/2002 | Tsutsui | |
| 2002/0171607 | A1 | 11/2002 | Senda et al. | |
| 2003/0025663 | A1 | 2/2003 | Waterman et al. | |
| 2003/0058235 | A1 | 3/2003 | Moon | |
| 2003/0063077 | A1 | 4/2003 | Koyama | |
| 2003/0085862 | A1 * | 5/2003 | Tsutsui | 345/90 |
| 2003/0174153 | A1 | 9/2003 | Koyama | |
| 2004/0038446 | A1 | 2/2004 | Takeda et al. | |
| 2004/0095364 | A1 | 5/2004 | Koyama et al. | |
| 2004/0127038 | A1 | 7/2004 | Carcia et al. | |
| 2004/0155873 | A1 * | 8/2004 | Miyazawa | 345/204 |
| 2004/0257359 | A1 | 12/2004 | Muroi et al. | |
| 2005/0007392 | A1 | 1/2005 | Kasai et al. | |
| 2005/0012731 | A1 | 1/2005 | Yamazaki et al. | |
| 2005/0017963 | A1 | 1/2005 | Yamazaki et al. | |
| 2005/0017964 | A1 | 1/2005 | Yamazaki et al. | |
| 2005/0127846 | A1 | 6/2005 | Kim | |
| 2005/0140641 | A1 * | 6/2005 | Kim et al. | 345/102 |
| 2005/0190142 | A1 * | 9/2005 | Ferguson | 345/102 |
| 2005/0275038 | A1 | 12/2005 | Shih et al. | |
| 2006/0055629 | A1 | 3/2006 | Van Woudenberg | |
| 2006/0082568 | A1 | 4/2006 | Yamazaki et al. | |
| 2006/0086933 | A1 | 4/2006 | Iechi et al. | |
| 2006/0108529 | A1 | 5/2006 | Saito et al. | |
| 2006/0108636 | A1 | 5/2006 | Sano et al. | |
| 2006/0114213 | A1 | 6/2006 | Yokoyama | |
| 2006/0125739 | A1 | 6/2006 | Tsutsui | |
| 2006/0170111 | A1 | 8/2006 | Isa et al. | |
| 2006/0197092 | A1 | 9/2006 | Hoffman et al. | |
| 2006/0228974 | A1 | 10/2006 | Thelss et al. | |
| 2006/0244702 | A1 | 11/2006 | Yamazaki et al. | |
| 2006/0273999 | A1 | 12/2006 | Yamazaki et al. | |
| 2006/0286737 | A1 | 12/2006 | Levy et al. | |
| 2007/0004202 | A1 | 1/2007 | Fujii | |
| 2007/0026580 | A1 | 2/2007 | Fujii | |
| 2007/0054507 | A1 | 3/2007 | Kaji et al. | |
| 2007/0072439 | A1 | 3/2007 | Akimoto et al. | |
| 2007/0108446 | A1 | 5/2007 | Akimoto | |
| 2007/0272922 | A1 | 11/2007 | Kim et al. | |
| 2008/0006877 | A1 | 1/2008 | Mardilovich et al. | |
| 2008/0024091 | A1 | 1/2008 | Yamazaki et al. | |
| 2008/0084403 | A1 | 4/2008 | Kimura et al. | |
| 2009/0141202 | A1 | 6/2009 | Yoshida | |

FOREIGN PATENT DOCUMENTS

| | | | |
|---|---|---|---|
| EP | 1 184 833 | A2 | 3/2002 |
| EP | 1 249 822 | | 10/2002 |
| EP | 1 298 636 | A2 | 4/2003 |
| EP | 1 298 637 | A2 | 4/2003 |
| EP | 1 531 453 | A2 | 5/2005 |
| EP | 1 538 591 | | 6/2005 |
| GB | 2 177 829 | | 1/1987 |
| JP | 7230077 | A | 8/1995 |
| JP | 08-069690 | | 3/1996 |
| JP | 11-133921 | | 5/1999 |
| JP | 2001154638 | A | 6/2001 |
| JP | 2001-324958 | | 11/2001 |
| JP | 2001-343933 | | 12/2001 |
| JP | 2002-108285 | | 4/2002 |
| JP | 2002-149113 | | 5/2002 |
| JP | 2003036057 | A | 2/2003 |
| JP | 2003-186455 | | 7/2003 |
| JP | 2003195256 | A | 7/2003 |
| JP | 2005342951 | A | 12/2005 |
| JP | 2007-096055 | | 4/2007 |
| JP | 2007-96055 | | 4/2007 |
| KR | 2003-027700 | A | 4/2003 |
| KR | 2005-045433 | A | 5/2005 |
| TW | 78107405 | | 1/1999 |
| WO | 2004/059605 | | 7/2004 |

OTHER PUBLICATIONS

Search Report (Application No. 06009376.2), dated Aug. 22, 2006, 4 pages.

Hajime Washio et al.; "TFT-LCDs with Monolithic Multi-Drivers for High Performance Video and Low-Power Text Modes"; *SID Digest '01 : SID International Symposium Digest of Technical Papers*; pp. 276-279; Jan. 1, 2001.

European Office Action (Chinese Application No. 06009376.2), 9 pages, mailed Apr. 23, 2008.

Asakuma et al., "Crystallization and Reduction of Sol-Gel-Derived Zinc Oxide Films by Irradiation with Ultraviolet Lamp," Journal of Sol-Gel Science and Technology, Issued Jan. 1, 2003, pp. 181-174.

Asakuma.N et al., "Crystallization and Reduction of Sol-Gel-Derived Zinc Oxide Films by Irradiation with Ultraviolet Lamp," Journal of Sol-Gel Science and Technology, 2003, vol. 26, pp. 181-184.

Korean Office Action (KR Application No. 2006-0045233) mailed Jan. 30, 2013, with English translation, 13 pages.

* cited by examiner

LIQUID CRYSTAL DISPLAY DEVICE, METHOD FOR DRIVING THEREOF AND ELECTRONIC APPARATUS

BACKGROUND OF THE INVENTION

1. Field of the Invention

The invention relates to a display device provided with a display screen which can display a character, a still image, a moving image, or the like, and relates to a technique for improving visibility of a display screen in various operating environments.

2. Description of the Related Art

A variety of electric appliances with a display screen structured by a liquid crystal panel, including a cell-phone, are prevalent. A liquid crystal panel has characteristics of being thin and light, and mobile laptop personal computers provided with a liquid crystal panel are produced. Furthermore, terminal devices called PDA (Personal Digital Assistant) are produced in large numbers, and becoming common.

As for display panels used in this way, not limited to a liquid crystal panel, the visual image quality is regarded as important, and panels provided with a function of adjusting the brightness and contrast automatically or manually are widely prevalent. For example, a liquid crystal display panel provided with an adjusting function which improves the visibility between one tone and another tone by changing transmission of the liquid crystal, without increasing luminance of a backlight of the liquid crystal panel is known (Reference 1: Japanese Patent Laid-Open No. 2003-186455).

SUMMARY OF THE INVENTION

A liquid crystal panel has good visibility in an indoor environment of from 300 to 700 lux, but the visibility deteriorates significantly in an outdoor environment of 1,000 lux or more, which has been a problem. Although there is a reflective liquid crystal panel having a structure in which the pixel electrode reflects external light, the image quality is lowered under an indoor fluorescent light, and a fundamental solution has not been achieved. That is, ensuring of visibility in a wide range from a dark place or under an indoor fluorescent light to under outdoor sunlight has not been achieved yet.

Thus, an object of the invention is to provide a display device in which display can be recognized even when it is set under from a dark place to strong external light.

The invention is a liquid crystal display device in which a plurality of pixels are provided in matrix, and the liquid crystal display device has a source driver, a gate driver, and at least a first display mode and a second display mode as a display mode, in which an analog signal is supplied to the source driver in the first display mode, a digital signal is supplied to the source driver in the second display mode, and the display mode is switched depending on external light intensity.

Moreover, the invention is a liquid crystal display device in which a plurality of pixels are provided in matrix, and the liquid crystal display device has a source driver, a gate driver, and at least a first display mode and a second display mode as a display mode, an analog signal is supplied to the source driver and the analog signal is supplied from the source driver to the plurality of pixels in the first display mode, a digital signal is supplied to the source driver and the digital signal is supplied from the source driver to the plurality of pixels in the second display mode, and the display mode is switched depending on external light intensity.

In the invention, a transistor may have various modes; therefore, the type of applicable transistor is not specifically limited. It is thus possible to apply a thin film transistor (TFT) using a non-single crystalline semiconductor film typified by amorphous silicon and polycrystalline silicon, a MOS transistor formed using a semiconductor substrate or an SOI substrate, a junction type transistor, a bipolar transistor, a transistor using a compound semiconductor such as ZnO or a-InGaZnO, a transistor using an organic semiconductor or a carbon nanotube, and other transistors. Note that a non-single crystalline semiconductor film may contain hydrogen or halogen. Further, the type of substrate on which a transistor is provided is not specifically limited and various types of substrates may be used. Thus, for example, a transistor can be formed on a single crystalline substrate, an SOI substrate, a glass substrate, a quartz substrate, a plastic substrate, a paper substrate, a cellophane substrate, a stone substrate, or the like. Alternatively, after a transistor is formed on a substrate, it may be transferred onto another substrate to be disposed.

The structure of a transistor is not specifically limited and various modes may be adopted. For example, it is possible to adopt a multi-gate structure having two or more gates. When using the multi-gate structure, an off-current can be reduced, the withstand voltage of a transistor can be increased to improve reliability, and variations in characteristics can be suppressed when the transistor operates in the saturation region since a drain-source current does not change much even when a drain-source voltage changes. Further, gate electrodes may be provided on and under a channel. The structure where gate electrodes are provided on and under a channel allows a channel region to be increased; therefore, a current value can be increased and a depletion layer is easily formed to increase the S value. Further, a gate electrode may be provided on a channel or a under a channel. A staggered structure or a reversed staggered structure may be adopted. A channel region may be divided into a plurality of regions, and these regions may be connected in parallel or in series. A source electrode or a drain electrode may overlap a channel (or a part of it). The structure where a source electrode or a drain electrode overlaps a channel (or a part of it) prevents charges from being accumulated in a part of the channel, which may cause unstable operation. In addition, an LDD region may be provided. When providing the LDD region, an off-current can be reduced, the withstand voltage of a transistor can be increased to improve reliability, and variations in characteristics can be suppressed when the transistor operates in the saturation region, since a drain-source current does not change much even when a drain-source voltage changes.

In the invention, "connection" includes electrical connection and direct connection. Accordingly, in the structures disclosed in the invention, other elements capable of electrical connection (such as a switch, a transistor, a capacitor, an inductor, a resistor, and a diode) may be provided, in addition to the predetermined connections. Alternatively, elements may be directly connected without another element sandwiched therebetween. Note that a case only including a case of directly connecting without another element enabling an electrical connection, not including a case of connecting electrically, is described "connected directly." Note that in a case of describing "connected electrically", a case of connecting electrically and a case of connecting directly are included.

In the invention, one pixel means one component for controlling brightness. As an example, one pixel means one color element to express the brightness. Accordingly, in the case of a color display device including R (red), G (green), and B (blue) color elements, the smallest unit of an image is constituted by three pixels: R pixel, G pixel, and B pixel. Note that the number of color elements is not limited to three, and more color elements may be used. For example, RGBW (W: white), RGB added with yellow, cyan, or magenta, and the like may be employed. As another example, if the brightness of one color element is controlled using a plurality of regions, one of the regions is referred to as one pixel. As an example, in the case of an area gray scale where the brightness of each color element is controlled using a plurality of regions and a gray scale is expressed by all the regions, one pixel means one of the regions for controlling brightness. In that case, one color element is constituted by a plurality of pixels. Further, in that case, each pixel may have a different size area that contributes to display. In addition, slightly different signals may be supplied to a plurality of regions for controlling the brightness of one color element, namely, a plurality of pixels constituting one color element, thereby increasing the viewing angle.

The invention includes a case that pixels may be provided (arrayed) in matrix. Pixels provided (arrayed) in matrix means a case where pixels are provided in a so-called lattice formed by combining a vertical stripe and a lateral stripe and provided in stripe each dot of color element. Pixels provided in matrix also include the case where, when three color elements (e.g., RGB) are used for full color display, dots of the three color elements are provided in a delta pattern, and further a Bayer pattern. The size of a light emitting region may be different in each dot of color elements.

A transistor is an element having at least three terminals including a gate, a drain, and a source. A gate means the whole or part of a gate electrode and a gate wire (also referred to as a gate line, a gate signal line, or the like). A gate electrode means a conductive film that overlaps a semiconductor constituting a channel region, an LDD (Lightly Doped Drain) region, or the like, with a gate insulating film interposed therebetween. A gate wire means a wire for connecting gate electrodes of pixels or a wire for connecting a gate electrode to another wire.

However, there is a portion that functions as both a gate electrode and a gate wire. Such a portion may be referred to as a gate electrode or a gate wire. That is, there is no clear distinction between a gate electrode and a gate wire in some regions. For example, if a channel region overlaps an extending gate wire, the region functions as both a gate wire and a gate electrode. Accordingly, such a region may be referred to as a gate electrode or a gate wire.

In addition, a region that is formed of the same material as a gate electrode and connected to the gate electrode may also be referred to as a gate electrode. Similarly, a region that is formed of the same material as a gate wire and connected to the gate wire may also be referred to as a gate wire. Strictly speaking, such a region does not overlap a channel region or does not have a function of connecting to another gate electrode in some cases. However, there is a region that is formed of the same material as a gate electrode or a gate wire and connected to the gate electrode or the gate wire depending on manufacturing margins or the like. Therefore, such a region may be referred to as a gate electrode or a gate wire.

For example, in a multi-gate transistor, there are many cases that a gate electrode of one transistor is often connected to a gate electrode of another transistor with a conductive film that is formed of the same material as the gate electrode. Such a region may be referred to as a gate wire since it connects gate electrodes to each other, or may be referred to as a gate electrode since a multi-gate transistor can be considered to be one transistor. That is to say, a region that is formed of the same material of a gate electrode or a gate wire and connected thereto may be referred to as a gate electrode or a gate wire. In addition, for example, a conductive film where a gate electrode is connected to a gate wire may be referred to as a gate electrode or a gate wire.

Note that a gate terminal means part of a gate electrode region or part of a region that is electrically connected to a gate electrode.

A source means the whole or part of a source region, a source electrode, and a source wire (also referred to as a source line, a source signal line, or the like). A source region means a semiconductor region containing a high concentration of a P-type impurity (such as boron or gallium) or an N-type impurity (such as phosphorus or arsenic). Accordingly, a source region does not include a region containing a low concentration of a P-type impurity or an N-type impurity, namely a so-called LDD (Lightly Doped Drain) region. A source electrode means a conductive layer in a portion where is formed of a material different from that of a source region and electrically connected to the source region. A source electrode includes a source region in some cases. A source wire means a wire for connecting source electrodes of pixels or a wire for connecting a source electrode to another wire.

However, there is a portion that functions as both a source electrode and a source wire. Such a portion may be referred to as a source electrode or a source wire. That is to say, there is no clear distinction between a source electrode and a source wire in some regions. For example, if a source region overlaps an extending source wire, the region functions as both a source wire and a source electrode. Accordingly, such a region may be referred to as a source electrode or a source wire.

In addition, a region that is formed of the same material as a source electrode and connected to the source electrode, or a portion connecting source electrodes to each other may also be referred to as a source electrode. Further, a portion that overlaps a source region may be referred to as a source electrode. Similarly, a region that is formed of the same material as a source wire and connected to the source wire may also be referred to as a source wire. Strictly speaking, such a region does not have a function of connecting to another source electrode in some cases. However, there is a region that is formed of the same material as a source electrode or a source wire and connected to the source electrode or the source wire depending on manufacturing margins or the like. Therefore, such a region may be referred to as a source electrode or a source wire.

In addition, for example, a conductive film where a source electrode is connected to a source wire may be referred to as a source electrode or a source wire.

Note that a source terminal means part of a source region, a source electrode, or a region that is electrically connected to a source electrode.

The description of the source applies to the drain.

In the invention, the word "on", such as in the phrase "formed on something" is not limited to the case of being directly formed on something, and includes the case of being formed on something with another thing interposed therebetween. Accordingly, the phrase "a layer B is formed on a layer A" includes the case where the layer B is formed directly on the layer A and the case where another layer (such as a layer C and a layer D) is formed directly on the layer A and the layer B is formed directly thereon. The same applies to the word "over", and the word is not limited to the case of being directly formed on something, and includes the case of being formed on something with another thing interposed therebetween. Accordingly, the phrase "a layer B is formed over a layer A" includes the case where the layer B is formed directly on the layer A and the case where another layer (such as a layer C and a layer D) is formed directly on the layer A and the layer B is formed directly on the layer. Note that the same applies to the word "under" or the word "below", and these words include the case of being directly formed under or below something, and the case of being formed under or below something with another thing interposed therebetween.

According to the invention, a display device whose visibility is excellent can be provided by controlling the number of gray scales of a display image depending on external light intensity. That is, a display device which secures visibility can be obtained in a wide range from under fluorescent light in a dark place or indoor to under outdoor sunlight.

DETAILED DESCRIPTION OF THE INVENTION

Embodiment Modes

Hereinafter, the embodiment modes of the present invention will be described with reference to the accompanying drawings. However, it is to be understood that various changes and modifications will be apparent to those skilled in the art. Therefore, unless such changes and modifications depart from the scope of the invention, they should be construed as being included therein.

(Embodiment Mode 1)

Figure 1:
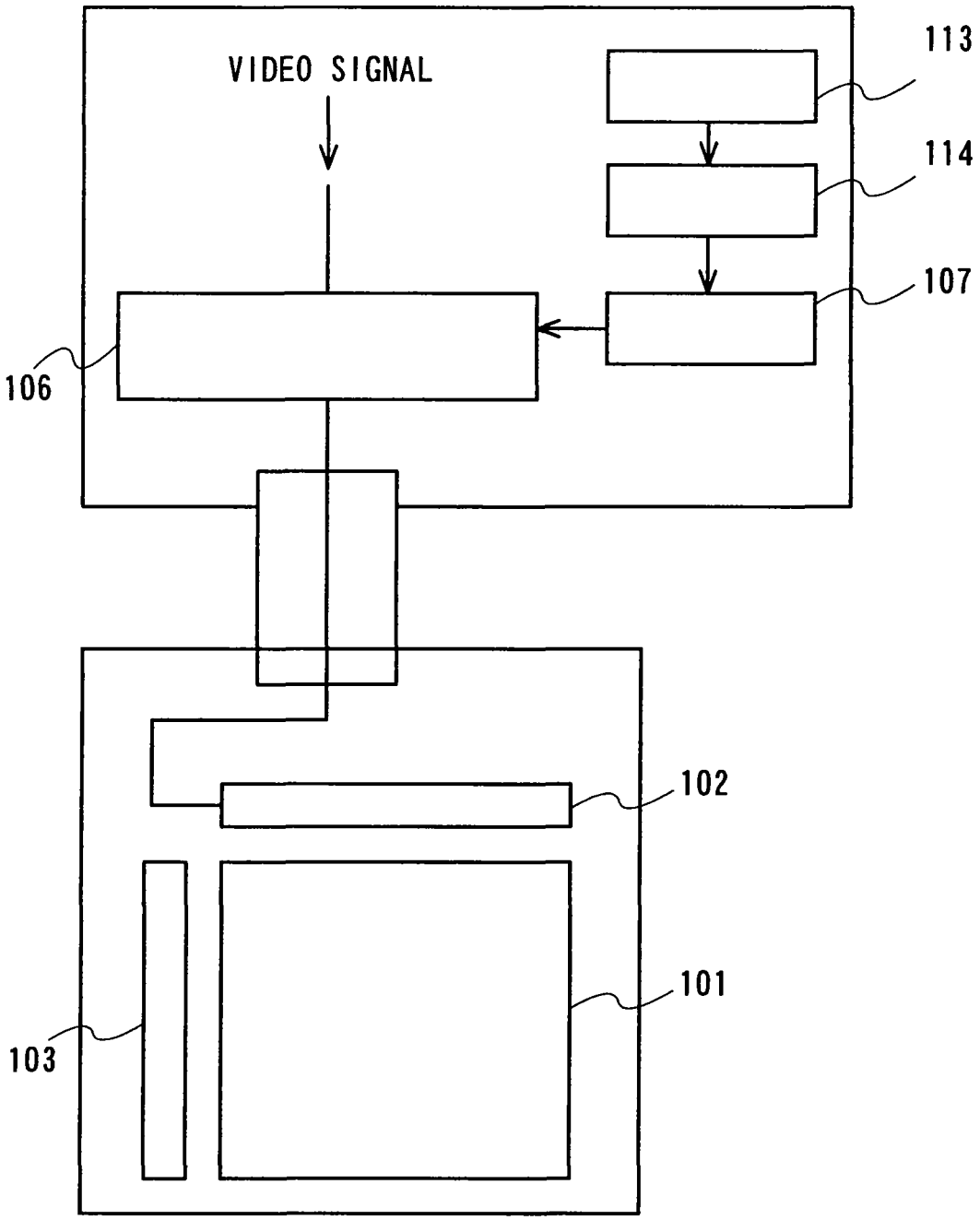
FIG. 1 is a diagram showing a structure of a display device of the invention.

FIG. 1 is an entire block diagram. A source driver 102 and a gate driver 103 are provided for driving a pixel array 101. A video signal is inputted to the source driver 102. Note that a plurality of source drivers 102 and a plurality of gate drivers 103 may be provided.

An optical sensor 113 detects external light (external light which a display device receives). The output is supplied to an amplifier 114. The amplifier 114 amplifies an electrical signal that the optical sensor 113 outputs and the amplified electrical signal is supplied to a controller 107. When an electrical signal outputted by the optical sensor 113 outputs is large enough, the amplifier 114 is not required to be provided.

Note that a source driver or one portion thereof are not on the same substrate as the pixel array 101, and for example, using an external IC chip, and the source driver or one portion thereof can be composed.

Note that the amplifier 114 or the optical sensor 113 may be formed on the same substrate as the pixel array 101. In that case, they may be formed on the same substrate as the pixel array 101. Alternatively, on the same substrate as the pixel array 101, the amplifier 114 the optical sensor 113 may be provided using COG (Chip On Glass), a bump, or the like.

Note that any kind of transistors may be used as a transistor in the invention, and the transistor in the invention may be formed on any kind of substrates as already described. Therefore, the circuit as shown in FIG. 1 may be formed on a glass substrate entirely, a plastic substrate, a single crystalline substrate, an SOI substrate, or any kind of substrates. Alternatively one portion of the circuit in FIG. 1 or the like is formed on a certain substrate, and another portion of the circuit in FIG. 1 or the like may be formed on another substrate. That is, all of circuits in FIG. 1 or the like are not required to be formed on the same substrate. For example, the pixel array 101 and the gate driver 103 may be formed using a TFT on a glass substrate in FIG. 1, or the like, and the source driver 102 (or one portion thereof) may be formed on a single crystalline substrate, the IC chip is connected by COG (Chip On Glass), and may be formed on a glass substrate. Alternatively, the IC chip may be connected to a glass substrate using TAB (Tape Auto Bonding) or a printed substrate.

Similarly, any kind of optical sensors may be used as the optical sensor in the invention, and may be formed on any kind of substrates. As examples of the optical sensor, there are a PIN diode, a PN diode, a Schottky diode, and the like. Moreover, the optical sensor may be formed using any kind of materials. It may be formed using amorphous silicon, polysilicon, single crystalline, SOI, or the like. When the optical sensor is formed of amorphous silicon or polysilicon, the optical sensor is formed on the same substrate and the same process at the same time as the pixel array; therefore, cost can be reduced.

Therefore, the optical sensor and the amplifier may all be formed on a glass substrate, a plastic substrate, a single crystalline substrate, or an SOI substrate. Alternatively one portion of the optical sensor or an amplifier is formed on a certain substrate, and another portion of the optical sensor or the amplifier may be formed on another substrate. That is, all of optical sensor and amplifier are not required to be formed on the same substrate. For example, the optical sensor 113, the pixel array 101 and the gate driver 103 are formed using a TFT on a glass substrate in FIG. 1, and the source driver 102 (or one portion thereof) is formed on a single crystalline substrate, the IC chip is connected by COG (Chip On Glass) to be provided on a glass substrate. Alternatively, the IC chip may be connected to a glass substrate using TAB (Tape Auto Bonding) or a printed substrate.

The video signal to be inputted to the source driver 102 is generated in a display mode-specific video signal generation circuit 106 in accordance with each display mode. The display mode-specific video signal generation circuit 106 is controlled using the controller 107. Moreover, an original video signal is inputted to the display mode-specific video signal generation circuit 106. Then, using the original video signal, in the display mode-specific video signal generation circuit 106, the video signal in accordance with each display mode is generated, and outputted to the source driver 102.

Based on the signal from the optical sensor 113, the controller 107 controls the display mode-specific video signal generation circuit 106. Then, by the signal from the optical sensor 113, that is, depending on the peripheral luminance, the number of gray scales of a video signal supplied to the source driver 102 or the like is controlled. When the number of gray scales is controlled, the number of gray scales may be changed gradually depending on the peripheral luminance, or switching may be used to switch from one display mode to another while some display modes are held while some display modes are held.

The display mode is mainly divided into an analog mode and a digital mode. As for the analog mode, a video signal inputted to a pixel becomes an analog value. On the other hand, as for the digital mode, a video signal inputted to a pixel becomes a digital value.

Based on the output of the optical sensor 113, a display mode, that is, the number of gray scales at expressing is changed. Specifically, when a display device receives strong external light, and when the output of the optical sensor 113 is equal to or more than a constant value, the total number of gray scales of an image to be expressed on a display screen is lowered. When the display device receives strong external light, an image to be displayed on a display screen becomes blurred without clear distinction between one gradation and another gradation. However, as described above, in accordance with the external light which a display device receives, the total number of gray scales is lowered and the distinction between one gradation and another gradation clear, so that visibility of the display screen of a display panel can be improved.

Moreover, when the total number of gray scales of an image to be displayed on a display screen by an output of an optical sensor 116 is set two gray scale levels, in general, a black display image is displayed on a white background image; however it is inverted and a white display image may be displayed on a black background image. Then, visibility of the display screen can be more improved. Moreover, visibility of the display screen can be more improved by increasing luminance of the white display image. This combination of the background image and the display image is not limited to white display on a black background. As long as the combination in easy contrast (ratio of light and dark becomes clear) is used, arbitrary-colored combination can be used.

The output of the optical sensor 113 is transmitted to the controller 107 through the amplifier 114. The controller 107 detects whether the output of the optical sensor 113 is equal to or higher a constant value. When the output of the light sensor 103 does not reach the certain value, the total grayscale number of a video signal outputted to the display panel 106 is not changed. On the other hand, in the case where the output of the optical sensor 113 is equal to or higher than a constant value, the total number of gray scales of a video signal outputted to the display panel is corrected to become lower.

As shown in Table 1, indoor or outdoor brightness varies according to the lighting condition, the climate condition such as weather, and time. For example, the illuminance in a room with lighting is approximately 800 to 1,000 lux, the illuminance under a cloudy sky of daytime is approximately 32,000 lux, and the illuminance under a clear sky of daytime reaches 100,000 lux.

TABLE 1

| Brightness (lux) | Rough Indication of Brightness | (lux) |
|---|---|---|
| 1,000,000 | Toyama Beach in midsummer | >100,000 |
| | Sunlight of Sunny day in Daytime | 100,000 |
| | Sunlight of Sunny day at 10am | 65,000 |
| | Sunlight of Sunny day at 3pm | 35,000 |
| | Sunlight of Cloudy day in Daytime | 32,000 |
| | Sunlight of Cloudy day at 10am | 25,000 |
| 10,000 | Sunlight of Cloudy day after 1 hour from sunrise | 2,000 |
| 1,000 | Sunlight of Sunny day at 1 hour befor sunset | 1,000 |
| | Lighting of Pachinko Parlors | 1,000 |
| | Lighting of Department Store | 500~700 |
| | Fluorescent Lamp of Office | 400~500 |
| | Sunlight at Sunrise/Sunset | 300 |
| | Two 30 W Fluorescent Lamp in eight-mat room | 300 |
| | Arcade at night | 150~200 |
| 100 | Under Fluorescent Lamp | 50~100 |
| | 30 cm away from Lighter | 15 |
| 10 | 20 cm away form candle | 10~15 |
| | Civil Twilight (Zenith Distance of Sun 96 degree) | 5 |
| 1 | Moonlight | 0.5~1 |
| | Nautical Twilight (Zenith Distance of Sun 102 degree) | 0.01 |
| | Astronomic Twilight (Zenith Distance of Sun 108 degree) | 0.001 |

A result of comparison among visibilities of a display panel using a transmissive liquid crystal panel (transmissive LCD panel), a semi-transmissive liquid crystal panel (semi-transmissive LCD panel), and a reflective liquid crystal panel (reflective LCD) under conditions with such various brightness is shown in Table 2.

TABLE 2

| | 500~1500[lx] | | ~10000[lx]~ | | 100000← | |
|---|---|---|---|---|---|---|
| | in Room → | ← in Lighted Hall → | | ← in the Open air of Clowdy day → | ← in the Open air of Sunny day | power consumption |
| Transmissive LCD Panel (1.9QVGA) | Good visibility is obtained with Natural Image and Text. However, contrast decreases compared with that of EL Panel. | ◎~○ | Same as above. Visibilitiy of Text is on an equality with EL Pannel. However, Visibility of Natural Image has no advantage over EL Pannel. | Δ~X | Visibility becomes exacerbated. Sometime, Obserber can not have visual under Direct sunshine. | X | ○~Δ |
| Semi-Transmissive LCD Panel (2.1QCIF+) | Good visibility is obtained with Natural Image and Text. However, contrast decreases compared with those of EL Panel and Transmissive LCD Panel. | ○ | Comparatively good visibility of Natural Image is obtaied. Contrast does not decrease. Color does not shift. | ○ | Comparatively good visibility is kept, since reflection component of external light increases. | ○ | ○ |
| Reflection LCD Pannel | Visibility decreases eminently. In low contrast, Visibility decreases. | Δ~X | In low contrast, Visibility decreases, when peripheral display part is Halftone. | ○ | Comparatively good visibility is kept, since reflection component of external light increases. | ○ | ◎ |

As a result, in the environment of brightness up to around 1,500 luxes (mainly, indoor, a hall with lighting, or the like), excellent visibility is obtained regardless of a display pattern (a natural image, a text (character, symbol) or the like) in various liquid crystal panels except for the reflective liquid crystal panel. On the other hand, in 10,000 luxes (daytime cloudiness time), in a case of displaying a natural image in the transmissive liquid crystal panel, the visibility of low contrast portion such as a half-tone portion tends to be greatly decreased. In the environment from indoor to outdoor in the semi-transmissive liquid crystal panel, generally contrast is slightly low; however excellent visibility is obtained in the environment of 10,000 luxes. The reflective liquid crystal panel is good in power consumption; however in the environment in which illuminance is comparatively low such as indoor, visibility tends to be decreased. In the transmissive liquid crystal panel, power consumption is higher than the reflective liquid crystal panel since back light consumes power.

As is apparent from TABLE 2, by using the transmissive liquid crystal panel or the semi-transmissive liquid crystal panel, the display mode in which the number of gray scales is regulated depending on external light intensity is set, so that visibility can be secured in the environment from indoor to outdoor.

For example, in the display device shown in FIG. 1, in a case of detecting that the display device receives an external light of 10 to 100 luxes by the output of the optical sensor 113, the total number of gray scales does not change from 64 to 1024. Moreover, in a case of detecting that the display device receives an external light of 100 to 1,000 luxes by the output of the optical sensor 113, the total number of gray scales is reduced to be corrected within a range of 16 to 64. In addition, in a case of detecting that the display device receives an external light of 1,000 to 10,000 luxes by the output of the optical sensor 113, the total number of gray scales is reduced to be corrected within a range of 4 to 16. Further, in a case of detecting that the display device receives external light of 10,000 to 100,000 luxes by the output of the optical sensor 113, the total number of gray scales is reduced to be corrected within a range of 2 to 4.

Note that a selecting switch by which a user selects a display mode may be provided to a display device. Then, a user operates the selecting switch, so that the aforementioned mode may be selected. In addition, even when the display mode is selected by the selecting switch, the gradation of selected display mode may be increased or decreased automatically in accordance with a signal of the optical sensor 113 (external light intensity).

Figure 2:
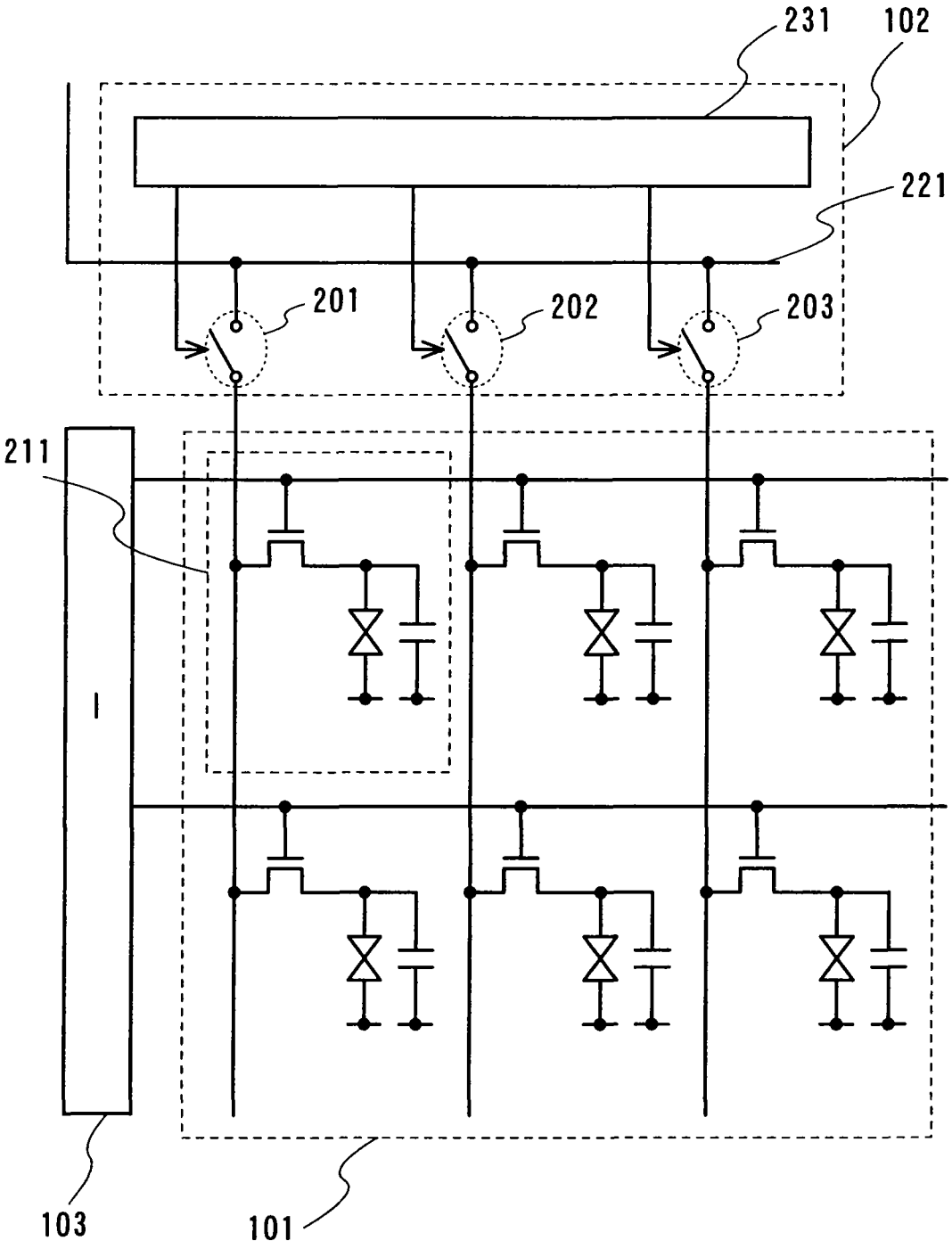
FIG. 2 is a diagram showing a structure of a display device of the invention.

Next, details of a circuit are described. FIG. 2 shows a structure of the source driver 102. A shift register 231 is a circuit which outputs a sequentially selecting signal (so-called sampling pulse). Therefore, the circuit is not limited to the shift register as long as a circuit that performs a similar function is used. For example, a decoder circuit may be used.

A sampling pulse that the shift register outputs is inputted to sampling switches 201 to 203. Then, a video signal is inputted to a video signal line 221 sequentially, in accordance with the sampling pulse, the sampling switches 201 to 203 are turned on sequentially and the video signal is inputted to the pixel array 101. In the pixel array 101, pixels 211 are provided in matrix.

Note that FIG. 2 shows a case where the pixels 211 are provided in three columns and two rows; however the invention is not limited to this. An arbitrary number of pixels can be provided.

Figure 15:
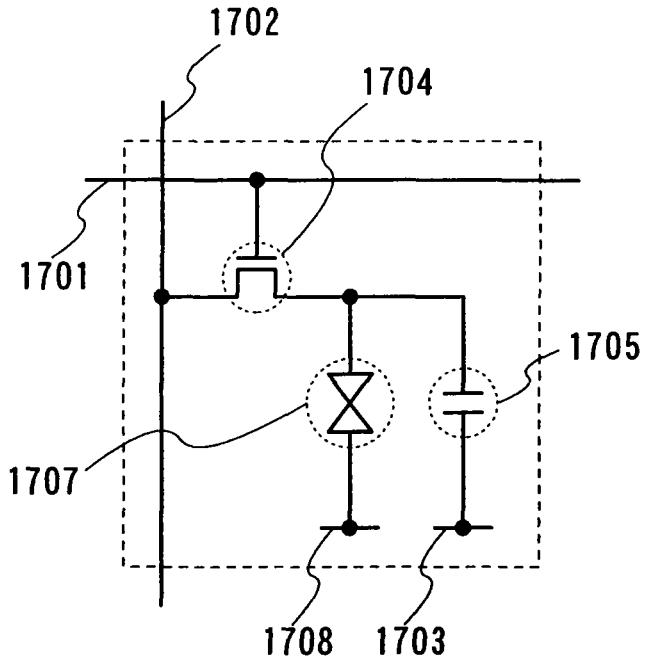
FIG. 15 is a diagram showing a structure of a display device of the invention.

FIG. 15 shows an example of a pixel 220 for one pixel. By using a gate signal line 1701, a selection transistor 1704 is controlled. When the selection transistor 1704 turns on, a video signal is inputted from a source signal line 1702 to a liquid crystal element 1707 or a storage capacitor 1705. Then, an oriented state of a liquid crystal molecule changes in accordance with the video signal. As a result, an amount of light passing through the liquid crystal element 1707 changes and gradation can be expressed.

Note that the pixel configuration is not limited to FIG. 15. For example, an electrode 1703 of a storage capacitor 1705 may be connected to a dedicated wire, or may be connected to a gate signal line of another pixel. In addition, a potential of the electrode 1703 of the storage capacitor 1705 is not required to be equal to a potential of a counter electrode 1708 of the liquid crystal element 1707. However, in a case of changing the potential of the counter electrode 1708 of the liquid crystal element 1707, it is preferable that the potential of the electrode 1703 of the storage capacitor 1705 is similarly changed.

Note that a light emitting element can employ various modes. For example, a display medium which changes contrast by an electromagnetic effect can be used, such as an EL element (organic EL element, inorganic EL element, or EL element containing organic material or inorganic material), an electron discharging element, a liquid crystal element, an electron ink, a light diffraction element, a discharging element, a digital micromirror device (DMD), a piezoelectric element, and a carbon nanotube. Note that an EL panel type display device using an EL element includes an EL display, a display device using an electron discharging element includes a field emission display (FED), an SED type flat panel display (Surface-conduction Electron-emitter Display), and the like, a liquid crystal panel type display device includes a liquid crystal display, a digital paper type display device using an electron ink includes electronic paper, a display device using a light diffraction element includes a grating light valve (GLV) type display, a PDP (Plasma Display Panel) type display using a discharging element includes a plasma display, a DMD panel type display device using a micro mirror element includes a digital light processing (DLP) type display device, a display device using a piezoelectric element includes a piezoelectric ceramic display, a display device. using a carbon nanotube includes a nano emissive display (NED), and the like.

Note that the storage capacitor 1705 functions to hold voltage of the liquid crystal element 1707. Accordingly, in a case where a potential can be held, the storage capacitor 1705 may be omitted.

The display mode-specific video signal generation circuit 106 may be formed on the same substrate as the pixel array 101, on the same substrate as the source driver 102, on an FPC (flexible printed circuit), or on a PCB (printed circuit board).

Moreover, the display mode-specific video signal generation circuit 106 may be formed of a similar transistor to the transistors forming the pixel array 101. Alternatively it may be formed using another transistor. For example, the pixel array 101 may be composed of thin film transistors, while the display mode-specific video signal generation circuit 106 may be composed of a MOS transistor or a bipolar transistor formed on a bulk substrate or an SOI substrate.

Figure 3:
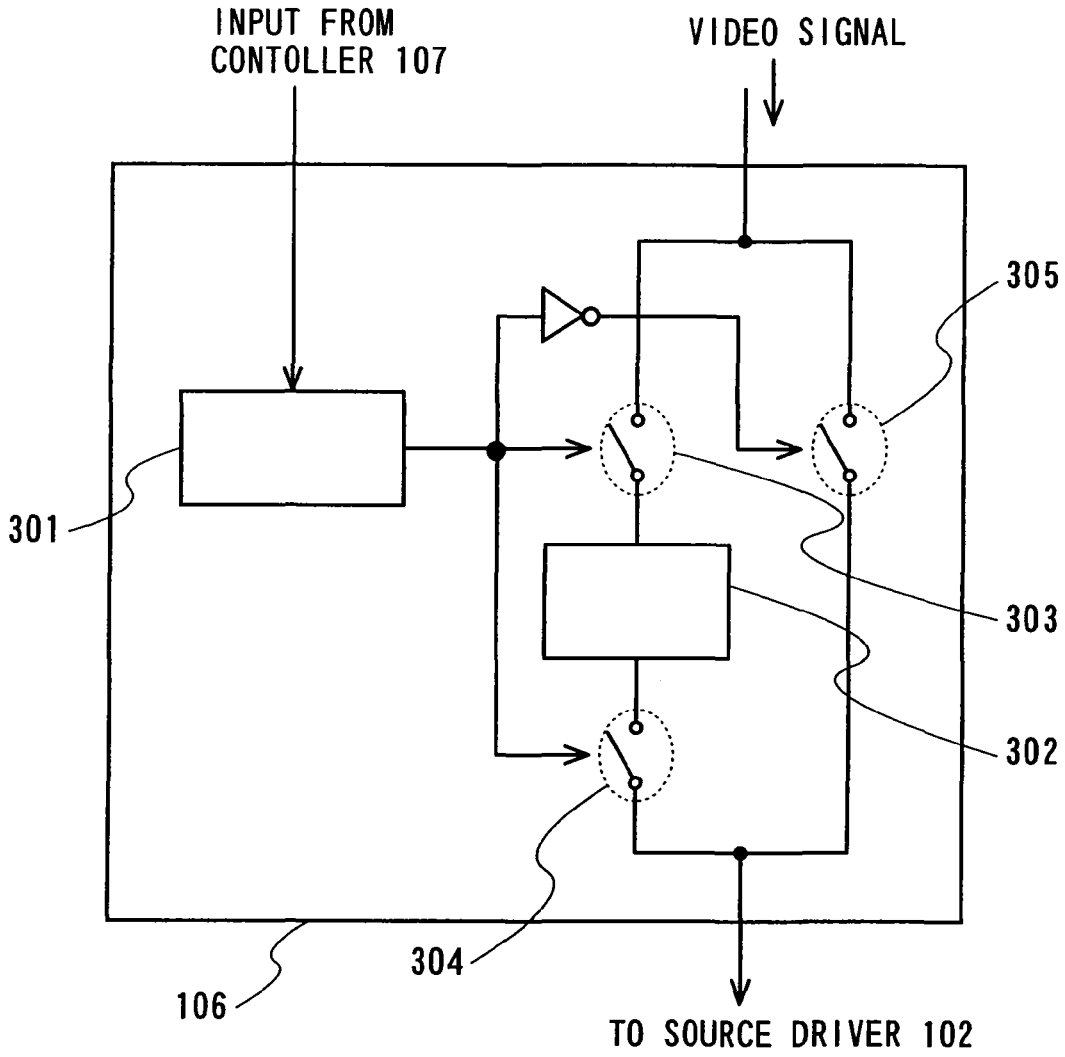
FIG. 3 is a diagram showing a structure of a display device of the invention.

Next, FIG. 3 shows details of the display mode-specific video signal generation circuit 106. Based on a signal inputted from the controller 107, a display mode control circuit 301 controls so that display is made in accordance with a display mode. For example, in a case of a digital mode, switches 303 and 304 are turned on. Then, an inputted video signal is processed by a binarization circuit 302 and outputted to the source driver 102. In this case, a switch 305 is turned off. On the other hand, in a case of an analog mode, the switch 305 is turned on and the inputted video signal is outputted to the source driver 102. In a case where a video signal to be inputted to the display mode-specific video signal generation circuit 106 is an analog value, the video signal is outputted without any change so that the video signal is outputted as an analog value to the source driver 102.

Note that FIG. 3 describes the case where a display mode is an analog mode and a digital mode; however the invention is not limited to this. A display mode which is a discrete value but not to be a binary is called a multi-valued mode. Examples of the relationship between a video signal and luminance are shown in FIGS. 4A to 4C.

Figure 4A:
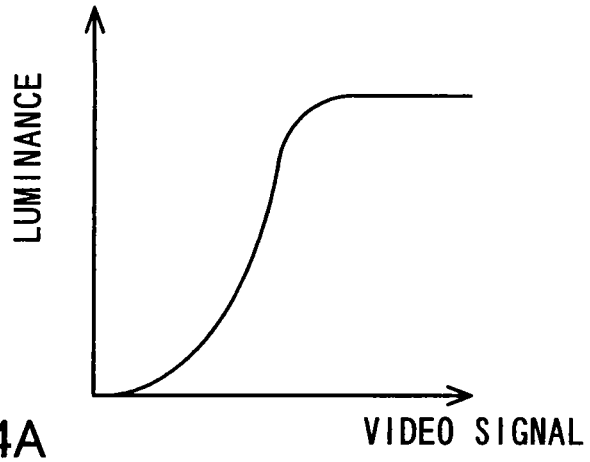
FIGS. 4A to 4C are diagrams each showing a driving method of a display device of the invention.

FIG. 4A shows a case of an analog mode in the present embodiment mode. A video signal changes in an analog manner, and accordingly, luminance also changes in an analog manner.

Figure 4B:
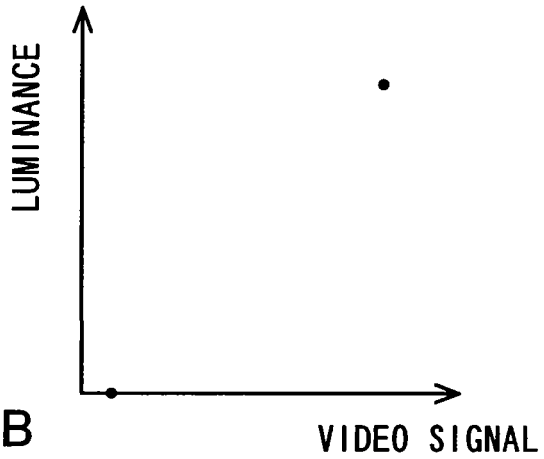

FIG. 4B shows a case of a digital mode in the present embodiment mode. A video signal is a binary value, and light is emitted at one value and not emitted at the other.

Figure 4C:
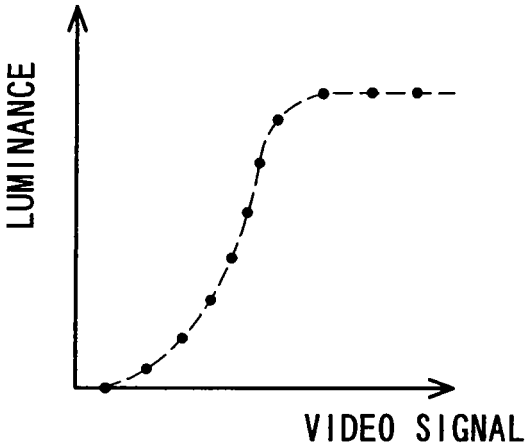

FIG. 4C shows a case of a multi-valued mode in the present embodiment mode. A video signal takes a discrete value; however is not a binary.

Note that FIGS. 4A to 4C show an example of a video signal at a positive electrode. A liquid crystal element is usually operated by an alternating current. Therefore, the polarity of a voltage to be added to both ends of the liquid crystal element is inverted as a predetermined time passes. Accordingly, a polarity of graphs of FIGS. 4A to 4C may be inverted in a video signal at a negative electrode. Then, a video signal of the positive electrode and a video signal of the negative electrode are added to the liquid crystal element alternately.

Figure 5:
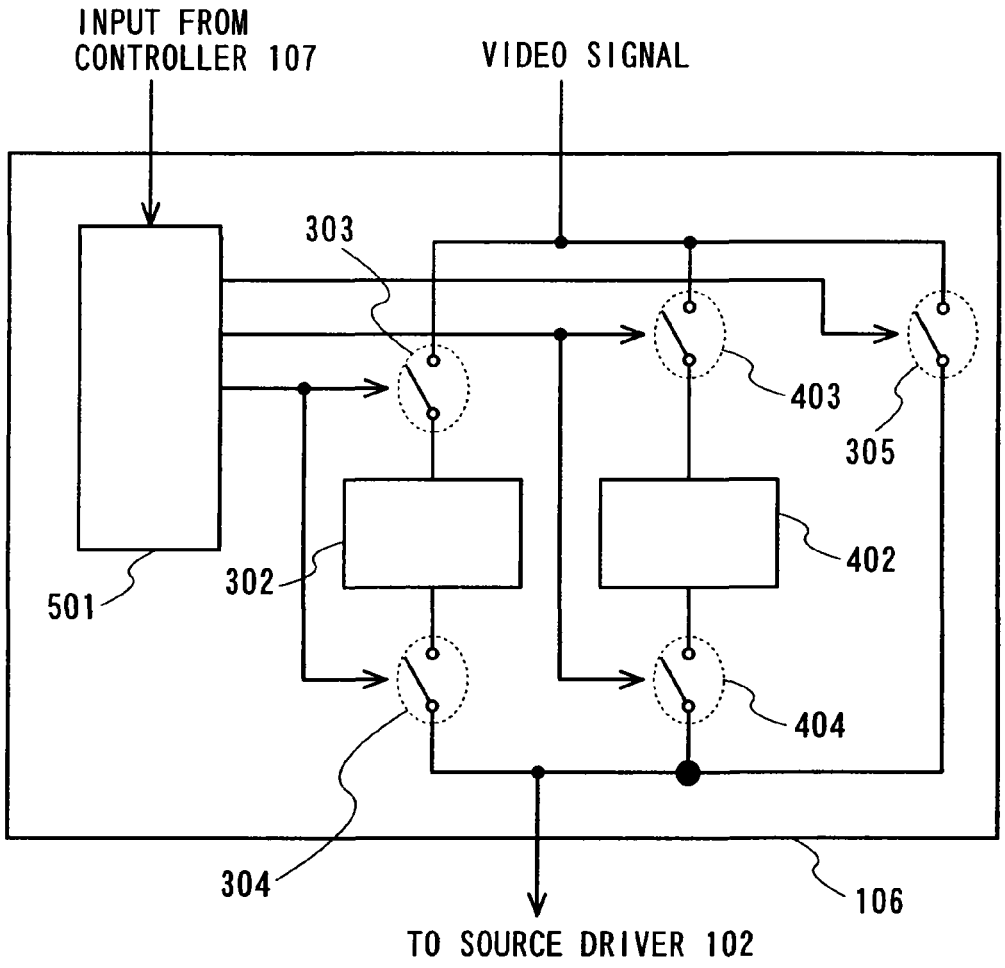
FIG. 5 is a diagram showing a structure of a display device of the invention.

Then, details of the display mode-specific video signal generation circuit 106 corresponding also to the case of the multi-valued mode are shown in FIG. 5. Based on a signal input from the controller 107, a display mode control circuit 501 performs control so that display according to a display mode can be performed. For example, in a case of a digital mode, the switches 303 and 304 are turned on. Then, the inputted video signal is processed by the binarization circuit 302 and outputted to the source driver 102. In that case, switches 403, 404, and the switch 305 are turned off. On the other hand, in a case of an analog mode, the switch 305 is turned on and the inputted video signal is outputted to the source driver 102 without any change. In a case where the video signal to be inputted to the display mode-specific video signal generation circuit 106 is an analog value, the video signal is outputted without any change so that the video signal is outputted as an analog value to the source driver 102. In a case of a multi-valued mode, the switches 403 and 404 are turned on. Then, the inputted video signal is processed by a multiple-valued circuit 402, and outputted to the source driver 102. In that case, the switches 303, 304, and 305 are turned off.

Figure 6A:
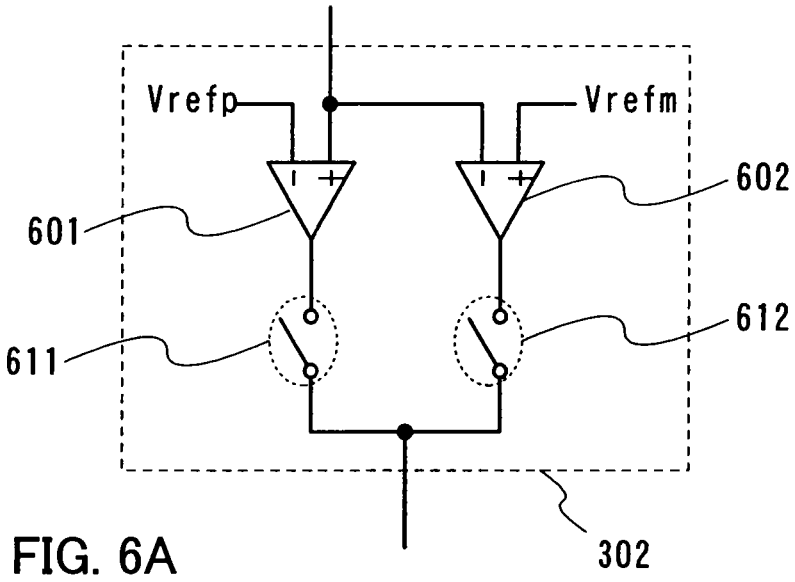
FIGS. 6A and 6B are diagrams each showing a structure of a display device of the invention.

Next, FIG. 6A shows details of the binarization circuit 302. As shown in the circuit diagram of FIG. 6A, comparator (comparison) circuits 621 and 622 are formed using an operational amplifier. For performing an alternating drive, liquid crystal usually requires a positive binarization circuit and a negative binarization circuit. The comparator circuit outputs the signal of H or L (a signal by which liquid crystal is turned on or off) depending on whether an input voltage is higher or lower than reference potentials Vrefp and Vrefm to perform binarization. Then, switches 611 and 612 switch which signal for positive electrode or for negative electrode is outputted. Note that the comparator circuit is formed using the operational amplifier, but the invention is not limited thereto. A chopper inverter comparator circuit may be used, or the comparator circuit may be formed using another circuit.

Figure 6B:
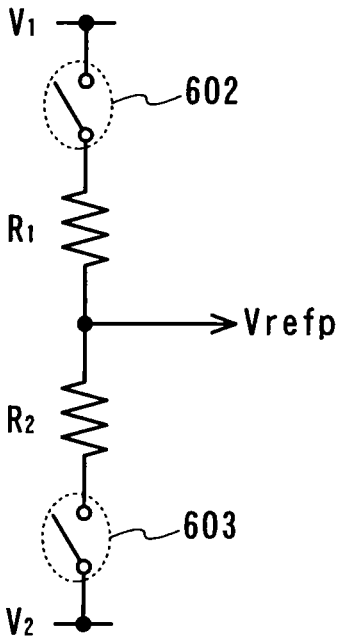

FIG. 6B shows a circuit for generating the reference potential Vrefp. The value of the reference potential Vrefp corresponds to the voltage between voltages V1 and V2 and becomes a value divided by resistors R1 and R2. Only when the binarization circuit is operated, switches 623 and 624 may be turned on. As a result, since a period when a current flows to the resistors R1 and R2 can be shortened, power consumption can be reduced.

FIG. 6B shows a circuit for generating the reference potential Vrefp; however the circuit for generating the reference potential Vrefm can be formed similarly by changing the value of a potential.

Figure 7:
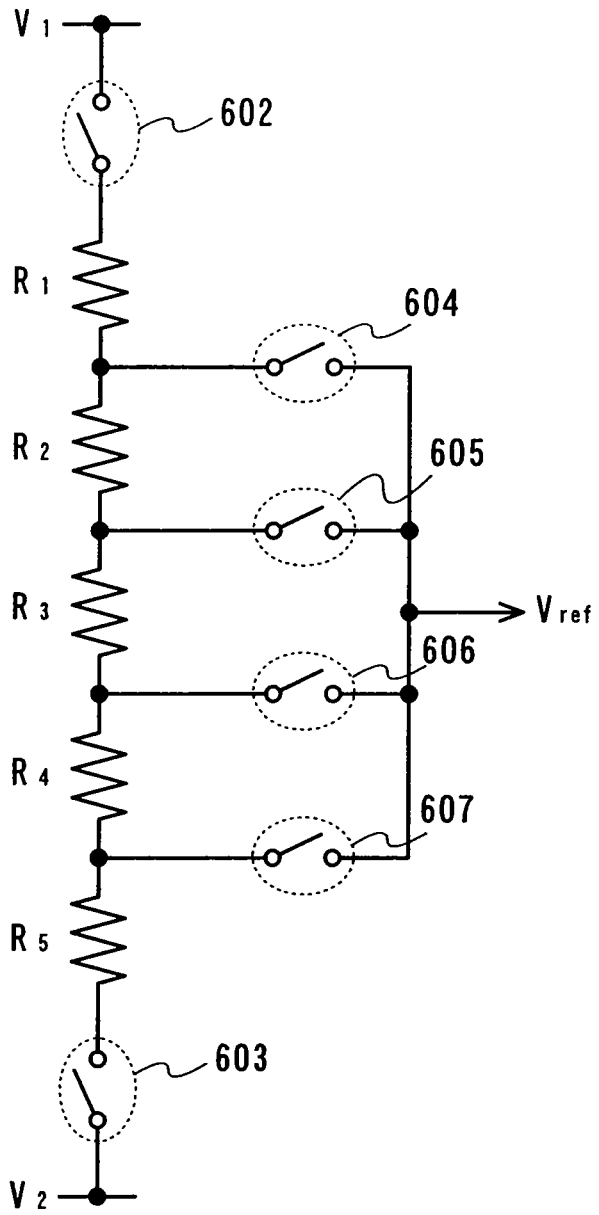
FIG. 7 is a diagram showing a structure of a display device of the invention.

Note that in a case where the reference potential Vref (Vrefp and Vrefm) is desired to be changed depending on the situation, it is preferable that many resistors (resistors R1, R2, R3, R4, and R5 in FIG. 7) are connected as shown in FIG. 7 and contacts for outputting are switched by turning on/off switches 604 to 607.

Figure 8A:
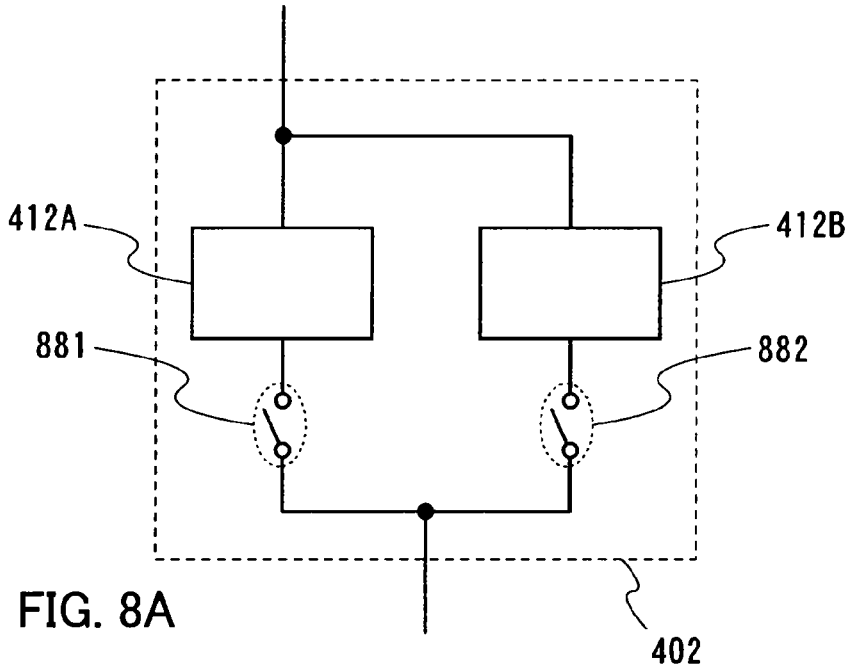
FIGS. 8A and 8B are diagrams each showing a structure of a display device of the invention.
Figure 8B:
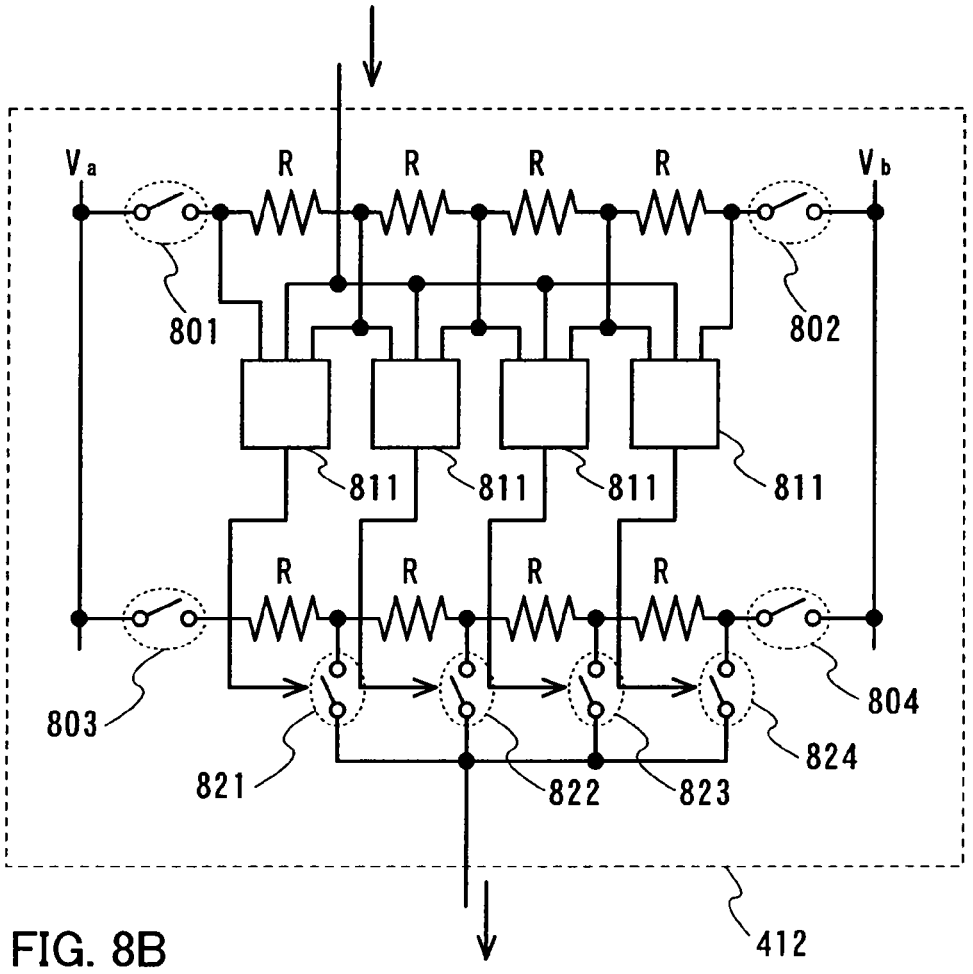

Next, FIGS. 8A and 8B show details of the multiple-valued circuit 402. FIG. 8A shows an entire block diagram of the multiple-valued circuit 402. Signals are inputted to a positive electrode multiple-valued circuit 412A and a negative electrode multiple-valued circuit 412B. Then, a switch 881 and a switch 882 are changed to output either a signal for positive electrode or a signal for negative electrode.

A detailed configuration view of the positive electrode multiple-valued circuit 412A and the negative electrode multiple-valued circuit 412B is shown in a multiple-valued circuit 412 of FIG. 8B. As for the multiple-valued circuit 412, the value of voltage Va and voltage Vb is different in the positive electrode multiple-valued circuit 412A and the negative electrode multiple-valued circuit 412B for a positive electrode and for a negative electrode.

An input signal is inputted to a determination circuit 811. Moreover, two voltages corresponding to a reference potential are inputted to the determination circuit 811. Then, in a case where a potential of the input signal is between two reference potentials, the determination circuit 811 outputs an H signal. As a result, one of switches 821 to 824 is turned on, and sampled voltage is outputted. Note that only when the multiple-valued circuit 402 is operated, switches 801 to 804 may be turned on. As a result, since a period during which a current flows between Va and Vb can be shortened, power consumption can be reduced.

Figure 9:
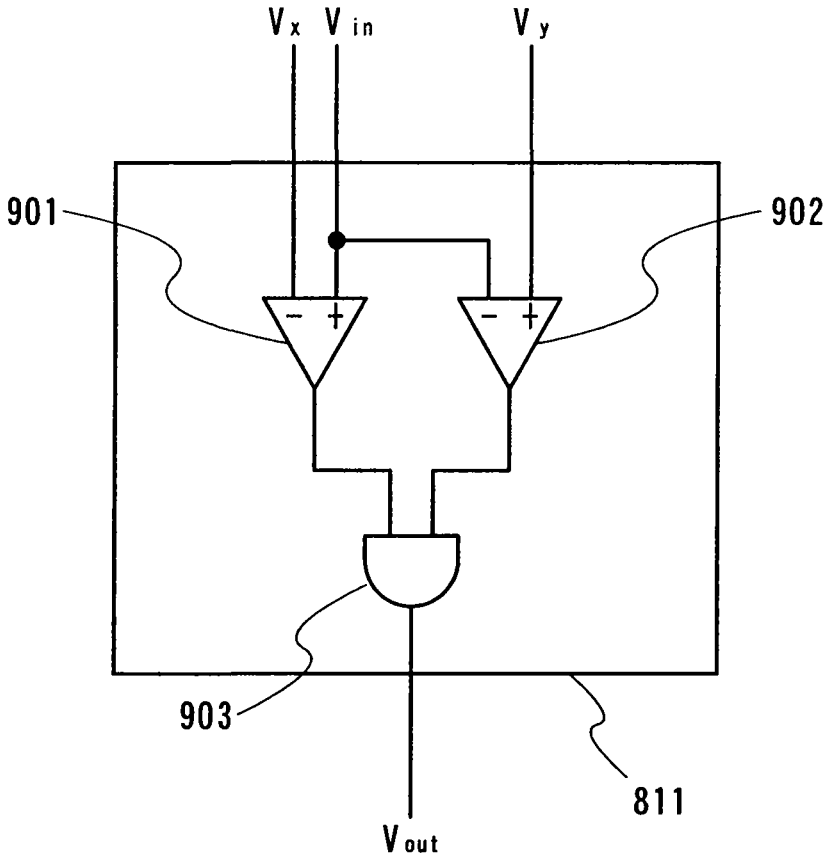
FIG. 9 is a diagram showing a structure of a display device of the invention.

FIG. 9 shows details of the determination circuit 811. A comparator (comparison) circuit is formed using operational amplifiers 901 and 902. When the potential Vin of an input signal is in the range of a reference potential Vx to a reference potential Vy, each of the operational amplifiers 901 and 902 outputs an H signal. Accordingly, the signals are inputted to an AND circuit 903. Then, when both of the input signals to the AND circuit 903 are H signals, an H signal is outputted.

Note that the determination circuit is formed using the AND circuit in FIG. 9; however the invention is not limited to this. When an OR circuit, a NAND circuit, or a NOR circuit is used, a similar function can also be performed.

In this manner, when display is performed in a digital mode or a multi-valued mode, thresholding is performed, sampling (sampling) of image data is performed. As a result, even an image including noise can be displayed with the noise removed when the image is actually displayed. Moreover, since a luminance change in each gray scale level is significant, contrast is enhanced.

Further, such a display mode selection can be controlled depending on external light intensity. In this manner, in accordance with peripheral illuminance, a display device whose visibility is excellent can be provided by controlling the number of gray scales of a display image. That is, a display device which secures visibility can be obtained in a wide range from under fluorescent light in a dark place or indoor to under outdoor sunlight.

Note that switches shown in FIG. 2, FIG. 3, FIG. 5 and the like, for example, various modes can be used as the sampling switch 201 or the like. As an example, there is an electrical switch, a mechanical switch, or the like. That is, as long as current-flow can be controlled, the invention is not limited to a particular switch and various switches can be used. For example, the switch may be a transistor, a diode (PN diode, PIN diode, Schottky diode, diode-connected transistor, or the like), or a logic circuit that is a combination thereof. Therefore, in a case where a transistor is used as a switch, since the transistor is operated just as a switch, a polarity (conductive type) of the transistor is not limited particularly. However, in a case where a lower off-current is desirable, a transistor which has a polarity with a lower off-current is desirably used. As the transistor with a low off-current, a transistor provided with an LDD region, a transistor having a multi-gate structure, or the like can be used. In addition, it is desirable to use an n-channel transistor when a transistor to be operated as a switch operates in a state where a potential of a source electrode thereof is close to a lower potential side power source (Vss, GND, or 0 V, or the like), whereas it is desirable to use a p-channel transistor when a transistor operates in a state where a potential of a source electrode thereof is close to a higher potential side power source (Vdd or the like). This is because the absolute value of a gate-source voltage can be increased, so that the transistor easily operates as a switch. Note that the switch may be of CMOS type using both an n-channel transistor and a p-channel transistor. In a case of a CMOS switch, even when a situation changes in such that a voltage which is outputted through a switch (that is, an input voltage to a switch) is high or low for an output voltage, a switch can be operated appropriately.

Figure 14A:
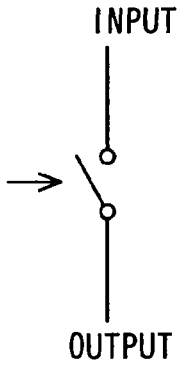
FIG. 14A to 14D are diagrams each showing a structure of a display device of the invention.
Figure 14B:
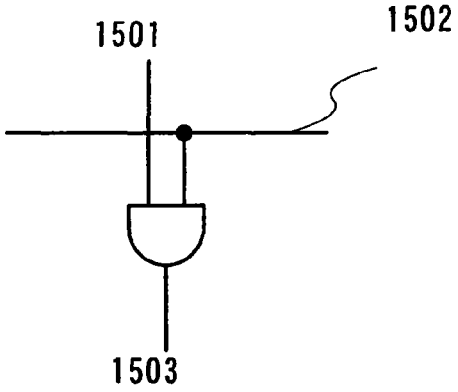

FIGS. 14A to 14D show an example of a switch. FIG. 14A is a switch described schematically. FIG. 14B is a switch using an AND circuit. A control line 1502 is used for controlling whether a signal of an input 1501 is transmitted to an output 1503. In a case of FIG. 14B, control is possible such that the output 1503 becomes an L signal regardless of an input signal. However, the output 1503 does not become a floating state. Therefore, in a case where the output 1503 is connected to an input of a digital circuit, or the like, a switch of FIG. 14B is preferably used. In a case of a digital circuit, even if an input is a floating state, an output does not become a floating state. When an input is a floating state, an output becomes unstable, which is undesirable. Accordingly, in a case of being connected to an input of a digital circuit, or the like, a switch of FIG. 14B is preferably used.

Note that the switch in FIG. 14B is formed using the AND circuit; however the invention is not limited to this. When an OR circuit, a NAND circuit, or a NOR circuit is used, a similar function can also be performed.

Figure 14C:
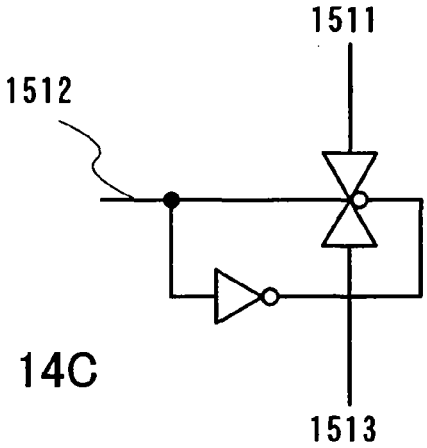
Figure 14D:
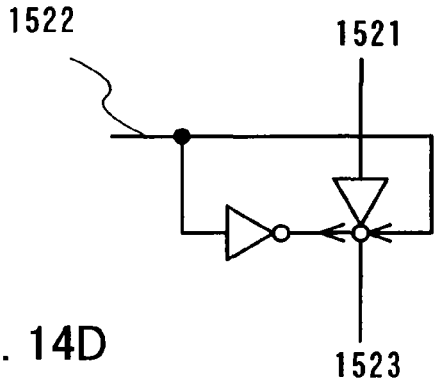

On the other hand, in a case where an input is desirably a floating state, a switch of FIG. 14C or FIG. 14D may be used. FIG. 14C is a circuit called a transmission gate, an analog switch, or the like. In FIG. 14C, a potential of an input 1511 is transmitted to an output 1513 with almost no change. Therefore, it is preferable to transmit an analog signal. FIG. 14D is a circuit called a clocked inverter, or the like. In FIG. 14D, a signal of an input 1521 is inverted and transmitted to an output 1523. Therefore, it is preferable to transmit a digital signal.

As set forth above, the switch in FIG. 14C is preferably used as the sampling switch 201, the switch 305, the switch 2511, or the like. The switch in FIG. 14C or FIG. 14D is suitable for the switch 304 or the like since an output is required to be put in a floating state. However, the switch in FIG. 14D is more suitable since the input to the switch 304 is a digital signal.

(Embodiment Mode 2)

Embodiment Mode 1 describes the case where a video signal to be inputted to the display mode-specific video signal generation circuit 106 is an analog value. Next, described is a case where a digital value is inputted.

Figure 24:
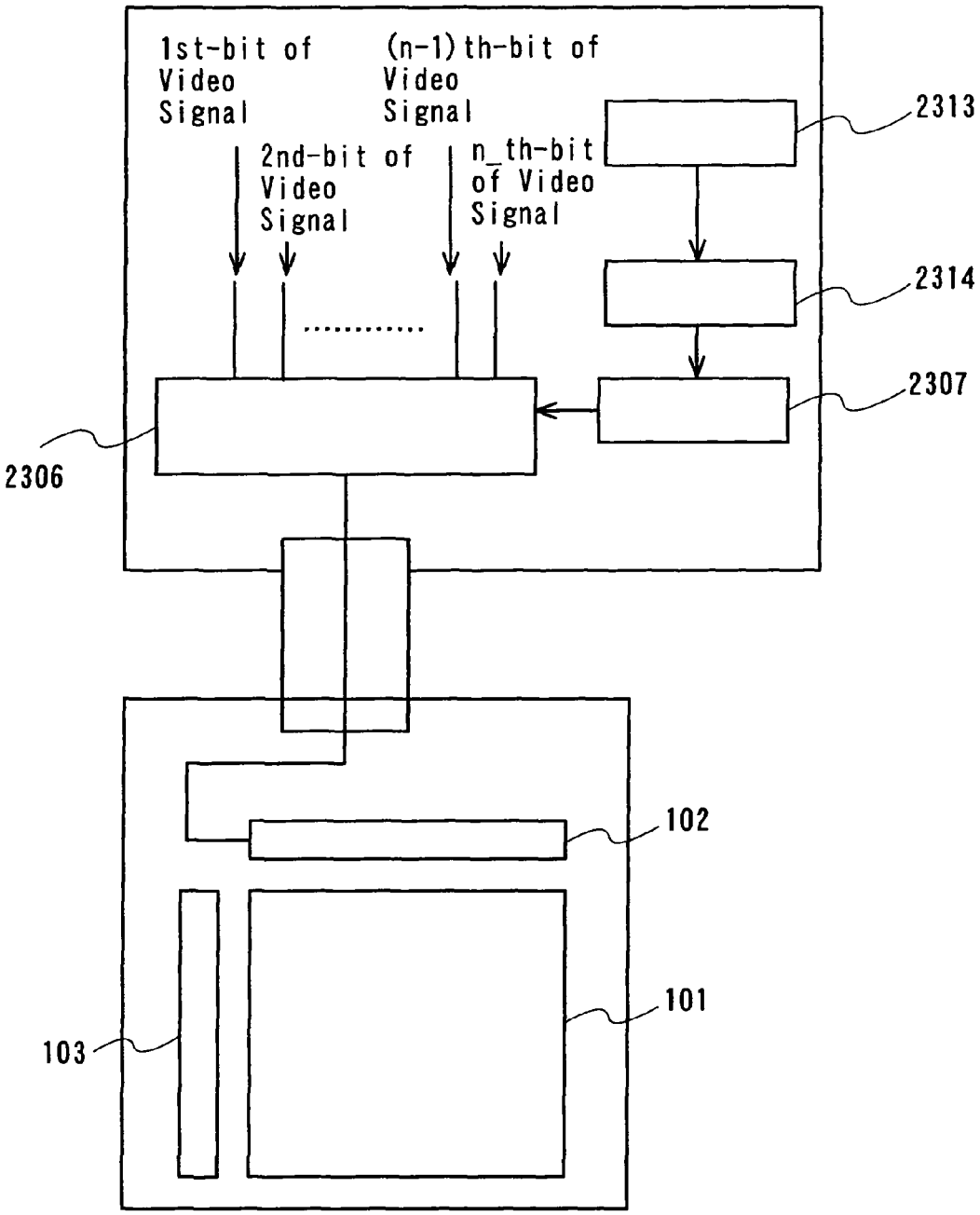
FIG. 24 is a diagram showing a structure of a display device of the invention.

FIG. 24 is an entire block diagram. A video signal to be inputted to the source driver 102 is generated in accordance with each display mode in a display mode-specific video signal generation circuit 2306. The display mode-specific video signal generation circuit 2306 is controlled using a controller 2307. Moreover, an original digital video signal is inputted to the display mode-specific video signal generation circuit 2306. Then, by using an original video signal, a video signal in accordance with each display mode is generated and outputted to the source driver 102 in the display mode-specific video signal generation circuit 2306.

An optical sensor 2313 detects external light (external light which a display device receives). The output is supplied to an amplifier 2314. The amplifier 2314 amplifies the electrical signal in which the optical sensor 2313 outputs and the amplified electrical signal is supplied to the controller 2307. When an electrical signal outputted by the optical sensor 2313 is large enough, the amplifier 2314 is not required to be provided.

Based on the signal from the optical sensor 2313, the controller 2307 controls the display mode-specific video signal generation circuit 2306. Then, by the signal from the optical sensor 2313, that is, depending on the peripheral luminance, the number of gray scales of a video signal supplied to the source driver 102 is controlled. When the number of gray scales is controlled, the number of gray scales may be changed gradually depending on the peripheral luminance, or switching may be used to switch from one display mode to another while some display modes are held.

Based on the output of the optical sensor 2313, a display mode, that is, the number of gray scales at expressing is changed. Specifically, when a display device receives strong external light and the output of the optical sensor 2313 is equal to or more than a constant value, the total number of gray scales of an image to be expressed on a display screen is lowered. When the display device receives strong external light, an image to be displayed on a display screen becomes blurred without clear distinction between one gradation and another gradation. However, as described above, in accordance with the external light which a display device receives, the total number of gray scales is lowered and the distinction between one gradation and another gradation is clear, so that visibility of the display screen of a display panel can be improved.

Note that the amplifier 2314 and the optical sensor 2313 may be on the same substrate as the pixel array 101. In that case, they may be formed on the same substrate as the pixel array 101. Alternatively, on the same substrate as the pixel array 101, the amplifier 2314 or the optical sensor 2313 may be provided using COG (Chip On Glass), a bump, or the like.

The display mode is mainly divided into an analog mode and a digital mode. As for the analog mode, a video signal inputted to a pixel becomes an analog value. On the other hand, as for the digital mode, a video signal inputted to a pixel becomes a digital value.

Figure 25:
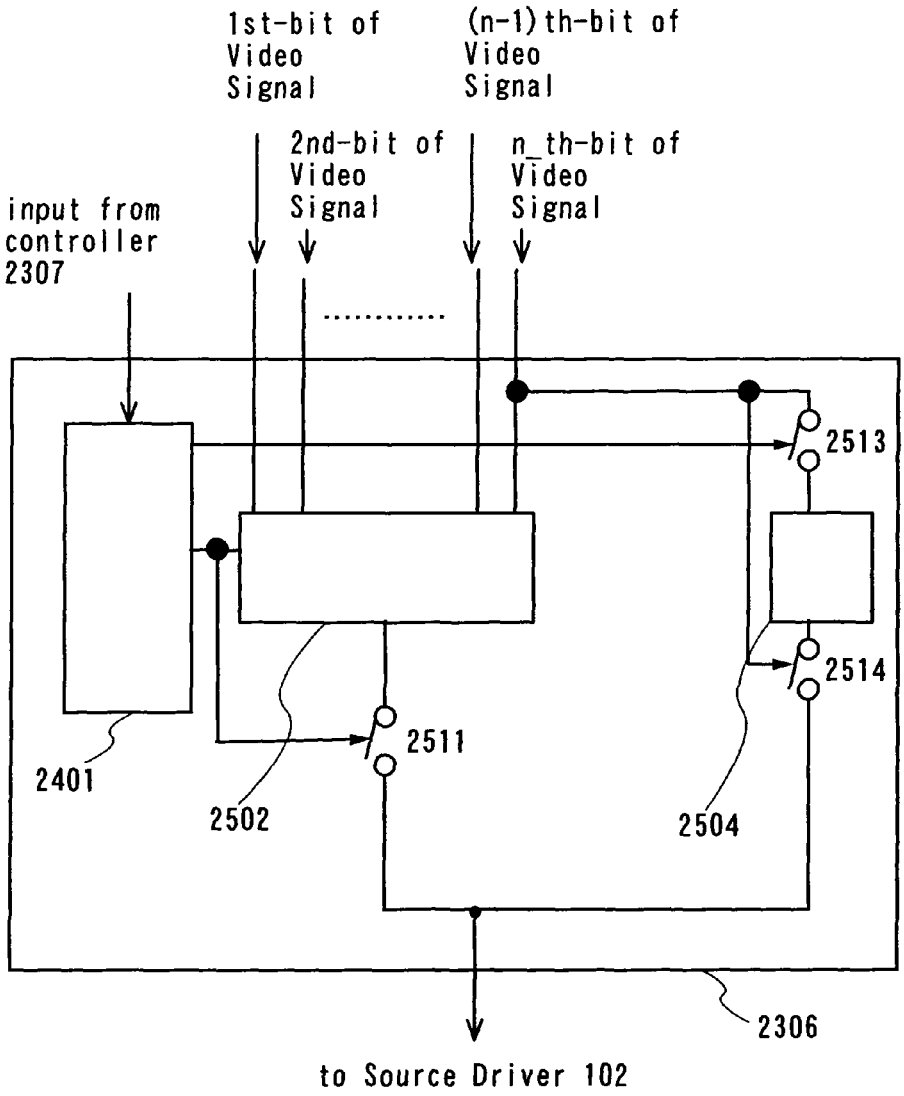
FIG. 25 is a diagram showing a structure of a display device of the invention.

Next, FIG. 25 shows details of the display mode-specific video signal generation circuit 2306. Based on a signal inputted from the controller 107, the display mode control circuit 301 performs control so that display according to a display mode can be performed. For example, in a case of a digital mode, switches 2513 and 2514 are turned on, and only the most significant bit of the video signal is outputted to the source driver 102. However, there is a case where a potential level does not meet. In that case, the potential level needs to be converted into a necessary level. In addition, it is necessary to generate a potential corresponding to a positive electrode and a negative electrode. Thus, when that is necessary, a level conversion circuit 2504 is provided. On the other hand, in the case of an analog mode, the video signal is transmitted to a DA converter circuit 2502, an appropriate analog value is outputted to the source driver 102 through a switch 2511. Note that in the DA converter circuit 2502, a potential of a video signal corresponding to a positive electrode and a negative electrode is generated.

Note that a circuit forming a positive electrode signal and a negative electrode signal may be provided between the source driver 102 and the display mode-specific video signal generation circuit 2306. For example, there is a circuit in which a positive electrode signal is inputted and converted into a negative electrode signal and outputted if necessary.

Note that FIG. 25 describes the case where the display mode is an analog mode and a digital mode; however the invention is not limited to this.

Figure 26:
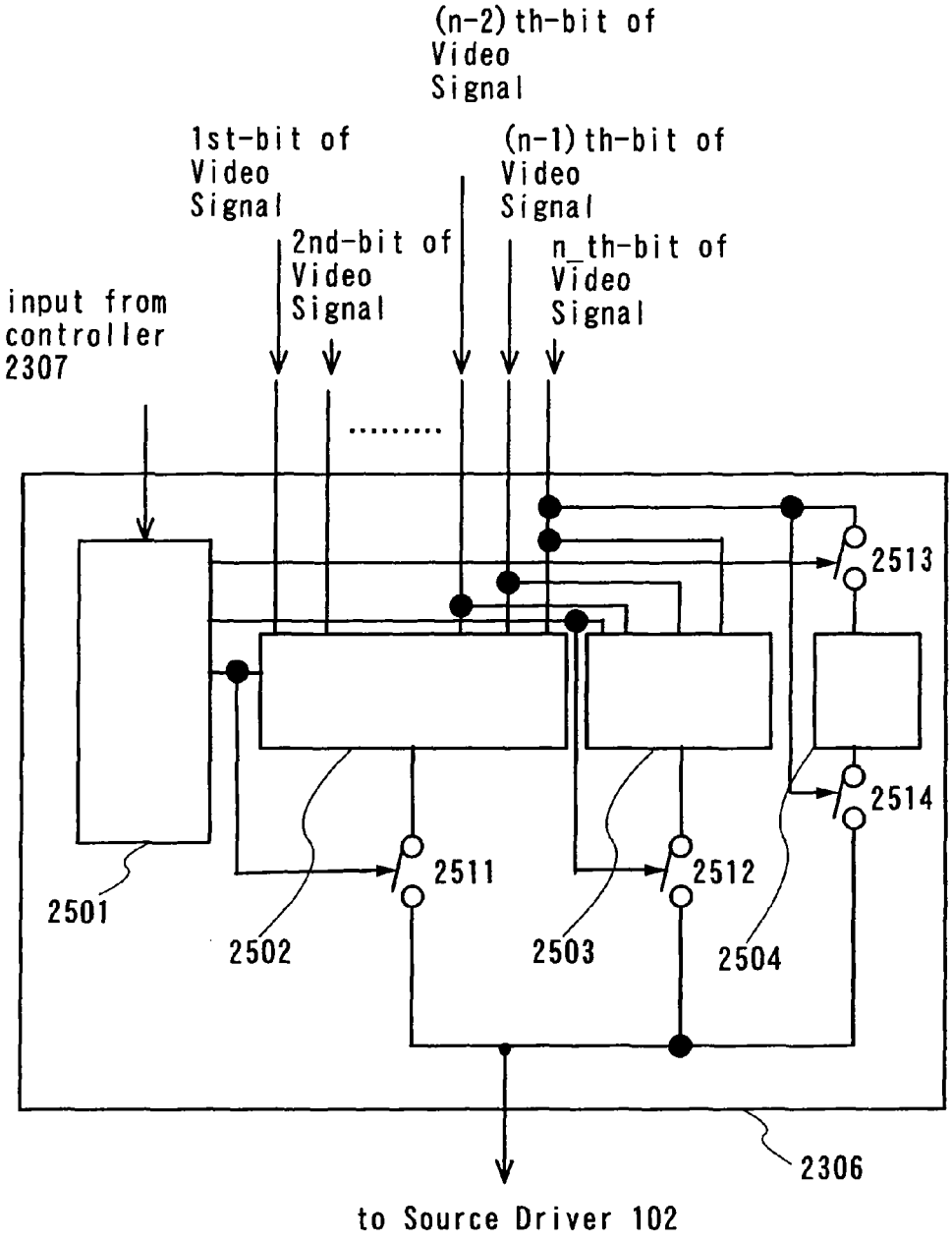
FIG. 26 is a diagram showing a structure of a display device of the invention.

Then, details of the display mode-specific video signal generation circuit 2306 corresponding also to the case of a multi-valued mode is shown in FIG. 26. Based on a signal inputted from the controller 2307, a display mode control circuit 2501 performs control so that display according to a display mode can be performed. The cases of an analog mode and a digital mode are similar to FIG. 25. In the case of a multi-valued mode, only a higher bit of a video signal is inputted to a DA converter circuit 2503. A lower bit is not inputted. Thus, not smooth display but sampled display is performed.

Figure 27:
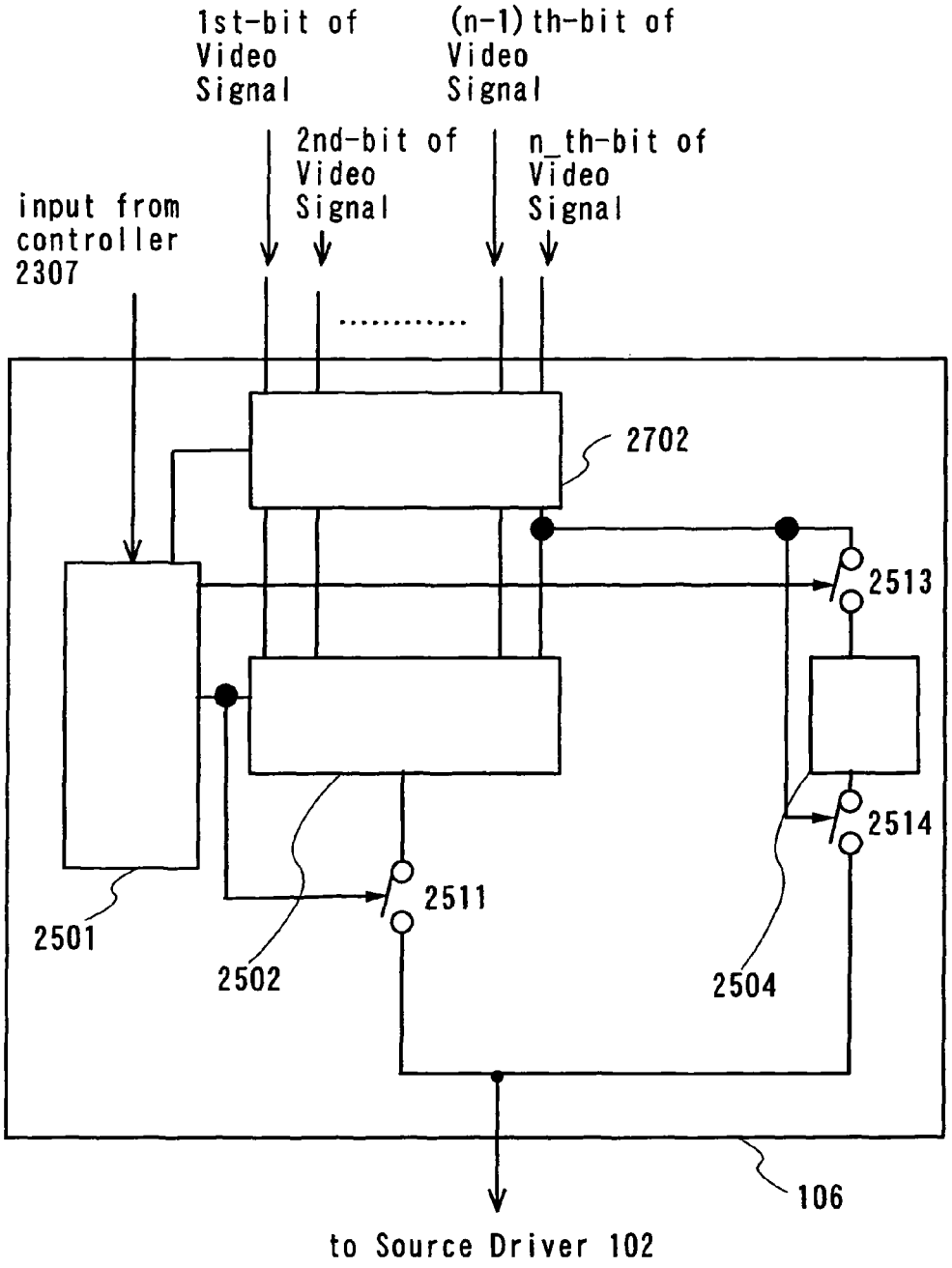
FIG. 27 is a diagram showing a structure of a display device of the invention.

Note that in a multi-valued mode, the invention is not limited to a structure of FIG. 26 since a signal may be sampled without using a low-order bit. For example, as shown in FIG. 27, a low-order bit data removal circuit 2702 may be provided at an input portion of the DA converter circuit 2502. As a result, in accordance with a signal of a display mode control circuit, a low-order bit value is set 0 (or L signal) forcibly. Thus, not smooth display but sampled display is performed.

Figure 28:
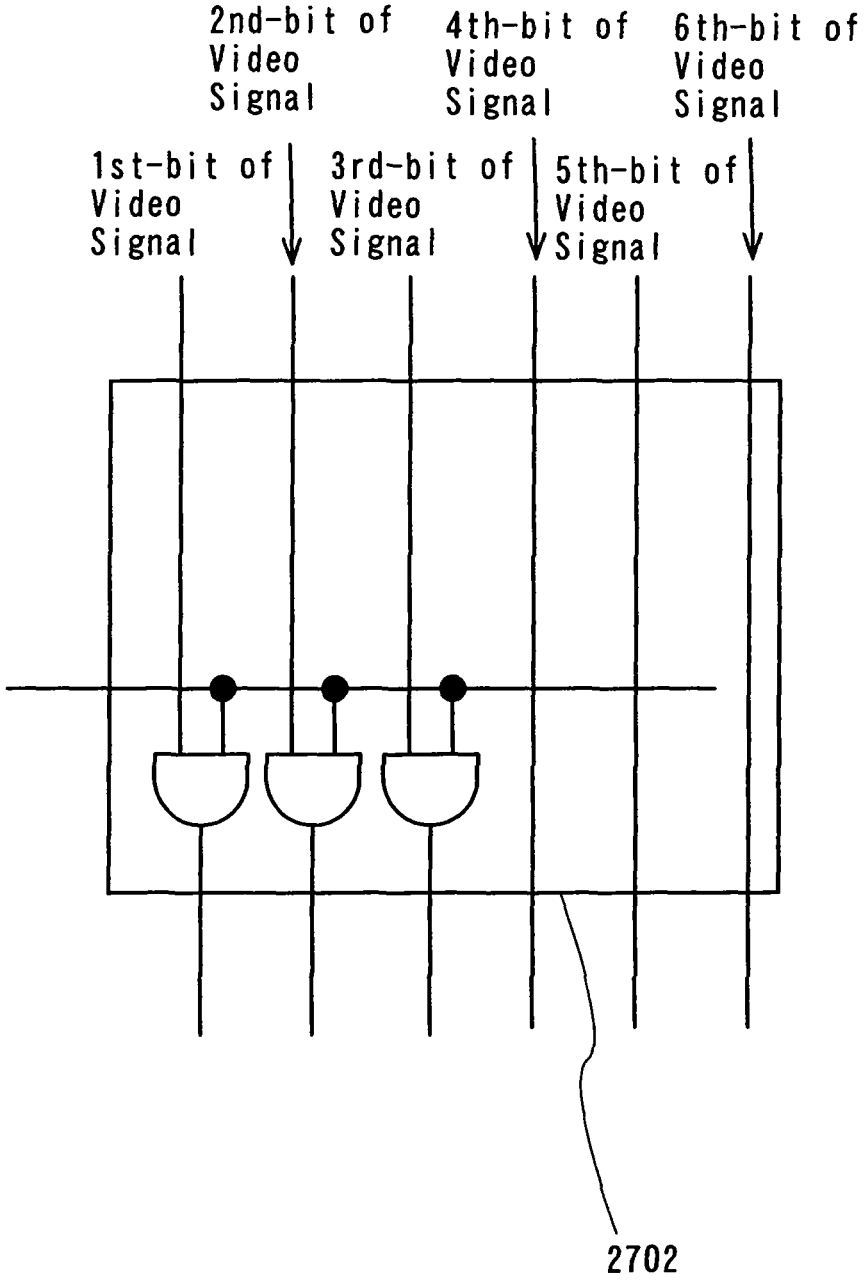
FIG. 28 is a diagram showing a structure of a display device of the invention.

Thus, FIG. 28 shows an example of the low-order bit data removal circuit 2702. An AND circuit is used, and data for lower 3 bits is set 0 (or L signal) forcibly.

Note that the AND circuit is used in FIG. 28; however the invention is not limited to this. If an OR circuit, an NAND circuit, or an NOR circuit is used, a similar function can also be performed. Moreover, in FIG. 28, a video signal of 6 bits is inputted, data for lower 3 bits thereof is set 0 (or L signal) forcibly; however the invention is not limited to this. Modification may be made appropriately.

Figure 29:
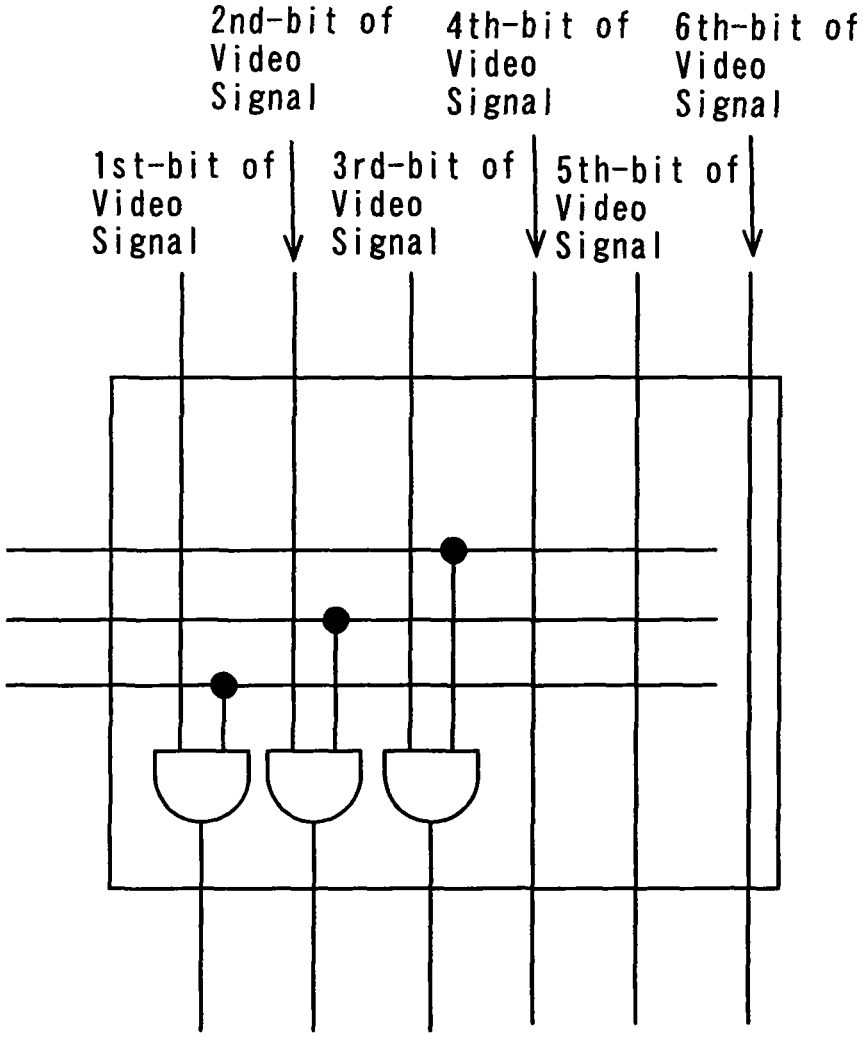
FIG. 29 is a diagram showing a structure of a display device of the invention.

Thus, during an actual operation, data for several bits may be changed to be set 0 (or L signal) forcibly. FIG. 29 shows a circuit diagram of that case. Since signals inputted to AND circuits are separated, the signals can be controlled individually.

Figure 30:
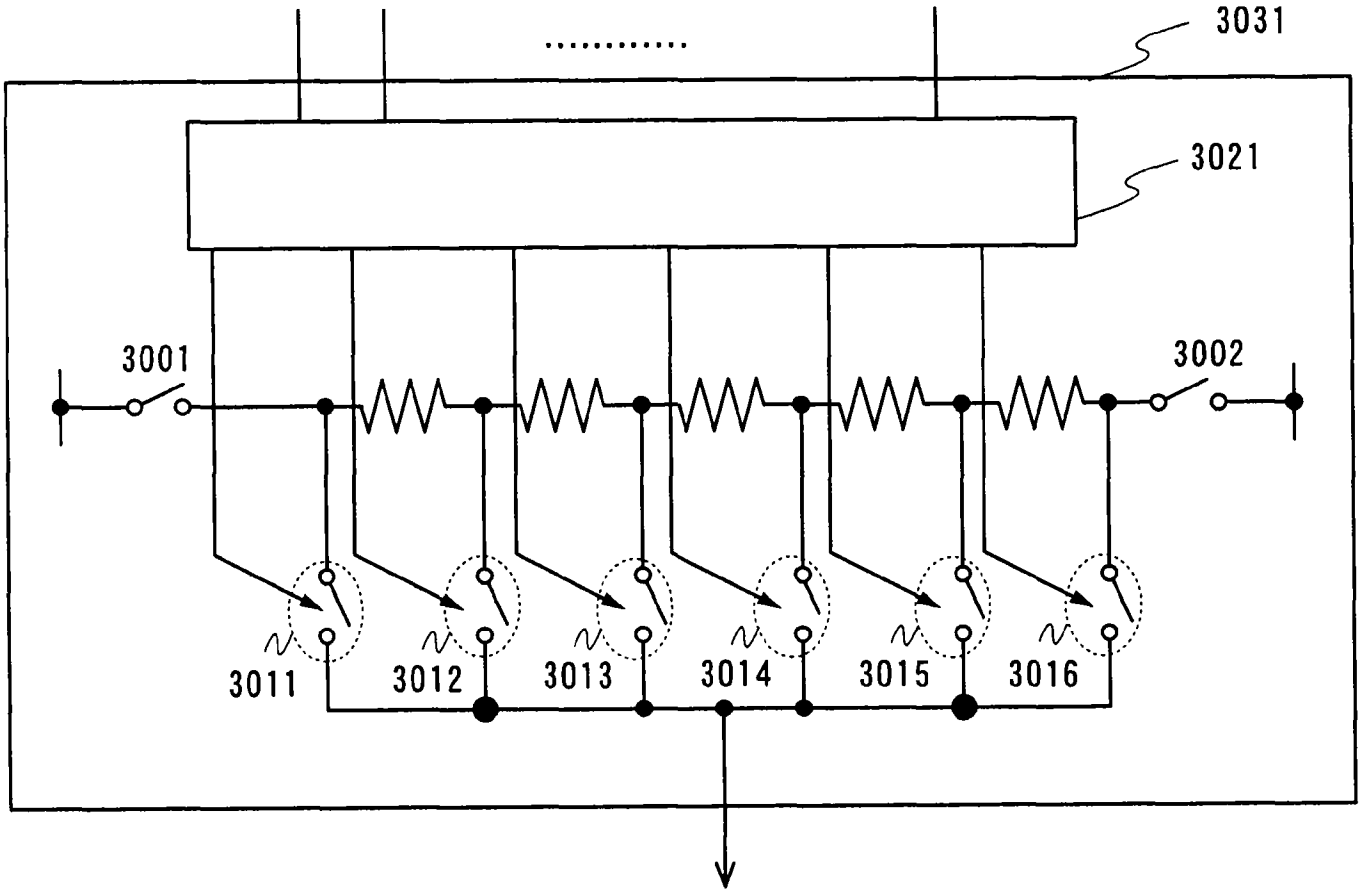
FIG. 30 is a diagram showing a structure of a display device of the invention.

Next, FIG. 30 shows details of the DA converter circuit described in FIGS. 25 to 27. A decoder circuit 3021 decodes the input digital signal, and accordingly, any of switches 3011 to 3016 is turned on to output an analog voltage. Then, only when the DA converter circuit is operated, switches 3002 and 3003 may be turned on. As a result, since a period during which a current flows to a resistor can be shortened, power consumption can be reduced.

However, there is a possibility that it is difficult to generate both positive electrode data and negative electrode data without any change in FIG. 30. Therefore, in this case, it is desirable to provide a circuit for forming a positive electrode signal and a negative electrode signal between the DA converter circuit and the source driver 102. For example, there is a circuit in which a positive electrode signal is inputted and converted into a negative electrode signal and outputted if necessary.

Figure 16:
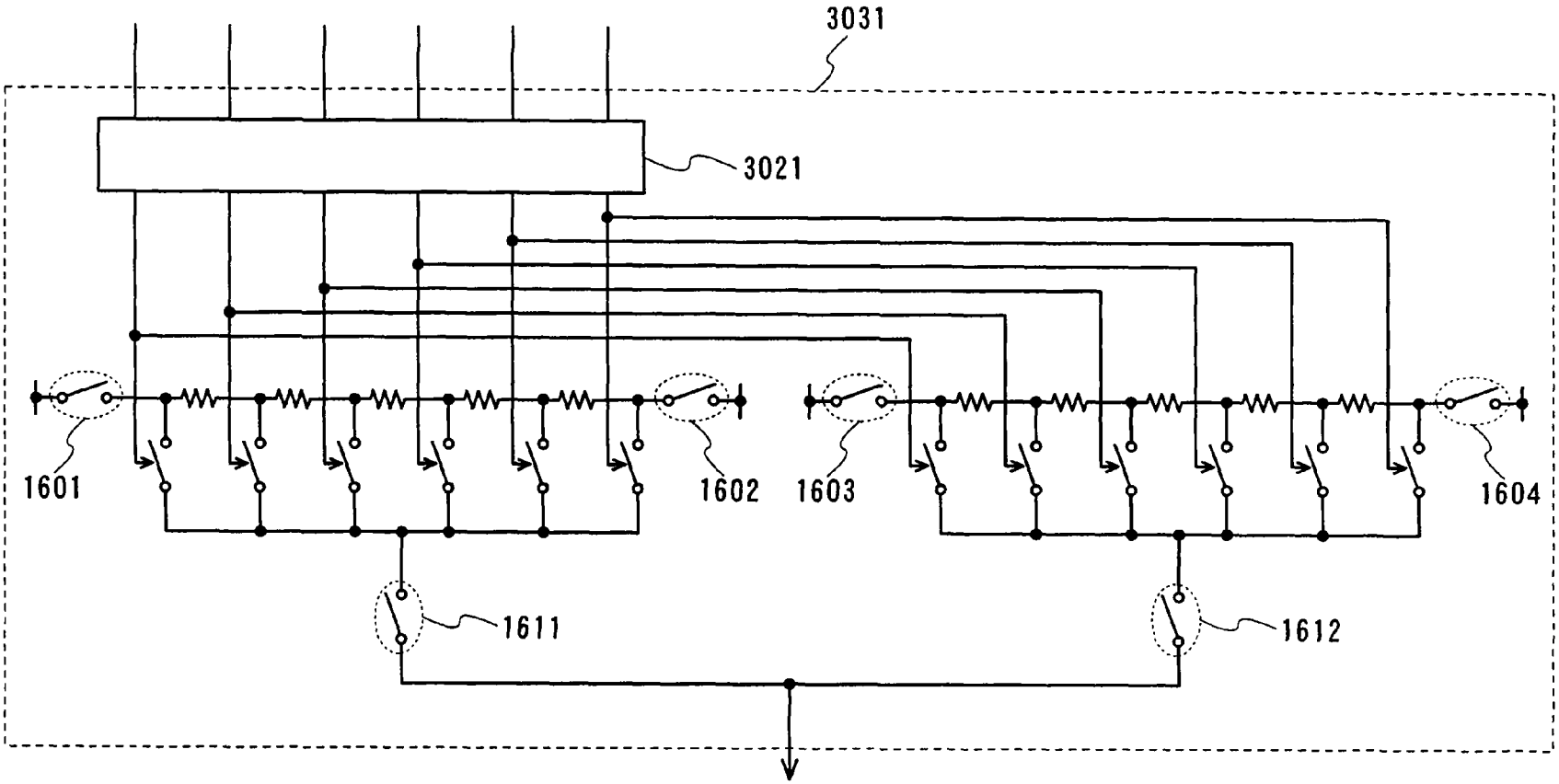
FIG. 16 is a diagram showing a structure of a display device of the invention.

FIG. 16 shows a case where such a circuit is not provided and the DA converter circuit has a function to generate both positive electrode data and negative electrode data. In FIG. 30, two circuits for generating a voltage are connected in parallel. In each circuit, positive electrode data and negative electrode data are generated. Then, switches 1611 and 1612 are switched, so that positive electrode data and negative electrode data are outputted.

In this manner, when display is performed in a digital mode or a multi-valued mode, thresholding is performed and sampling of image data is performed. As a result, even an image including noise can be displayed with the noise removed when the image is actually displayed. Moreover, since a luminance change in each gray scale level is significant, contrast is enhanced.

Further, such a display mode selection can be controlled depending on external light intensity. In this manner, in accordance with peripheral illuminance, a display device whose visibility is excellent can be provided by controlling the number of gray scales of a display image. That is, a display device which secures visibility can be obtained in a wide range from under fluorescent light in a dark place or indoor to under outdoor sunlight.

A content described in this embodiment mode can be freely combined with the content described in Embodiment Modes 1 to 2.

(Embodiment Mode 3)

A driving method of a pixel in an analog mode is described in this embodiment mode.

An analog gradation system is used as an analog mode and gradation is expressed. Therefore, it is desirable to operate in a state that an amount to transmit light changes in an analog manner by changing a voltage to be applied in a display element such as a liquid crystal element in an analog manner.

Note that this embodiment mode describes the case of an analog mode; however can be applied similarly to a case of a multi-valued mode.

Note that this embodiment mode describes a pixel of Embodiment Mode 1 in detail. Therefore, a content described in this embodiment mode can be freely combined with the content described in Embodiment Modes 1 and 2.

(Embodiment Mode 4)

A driving method of a pixel in a digital mode is described in this embodiment mode.

In a digital mode, a signal is limited to a binary of H and L. Accordingly, a state of a liquid crystal element is limited to a binary whether a voltage is applied or not. That is, in a digital mode, the state of the liquid crystal element is limited whether light is transmitted or not.

Note that in a case where color display is performed in a digital mode, eight colors in total can be displayed because of displaying with a binary for each RGB.

Note that this embodiment mode describes a pixel of Embodiment Mode 1 or the like in detail. Therefore, a content described in this embodiment mode can be freely combined with the content described in Embodiment Modes 1 to 3.

(Embodiment Mode 5)

Figure 17:
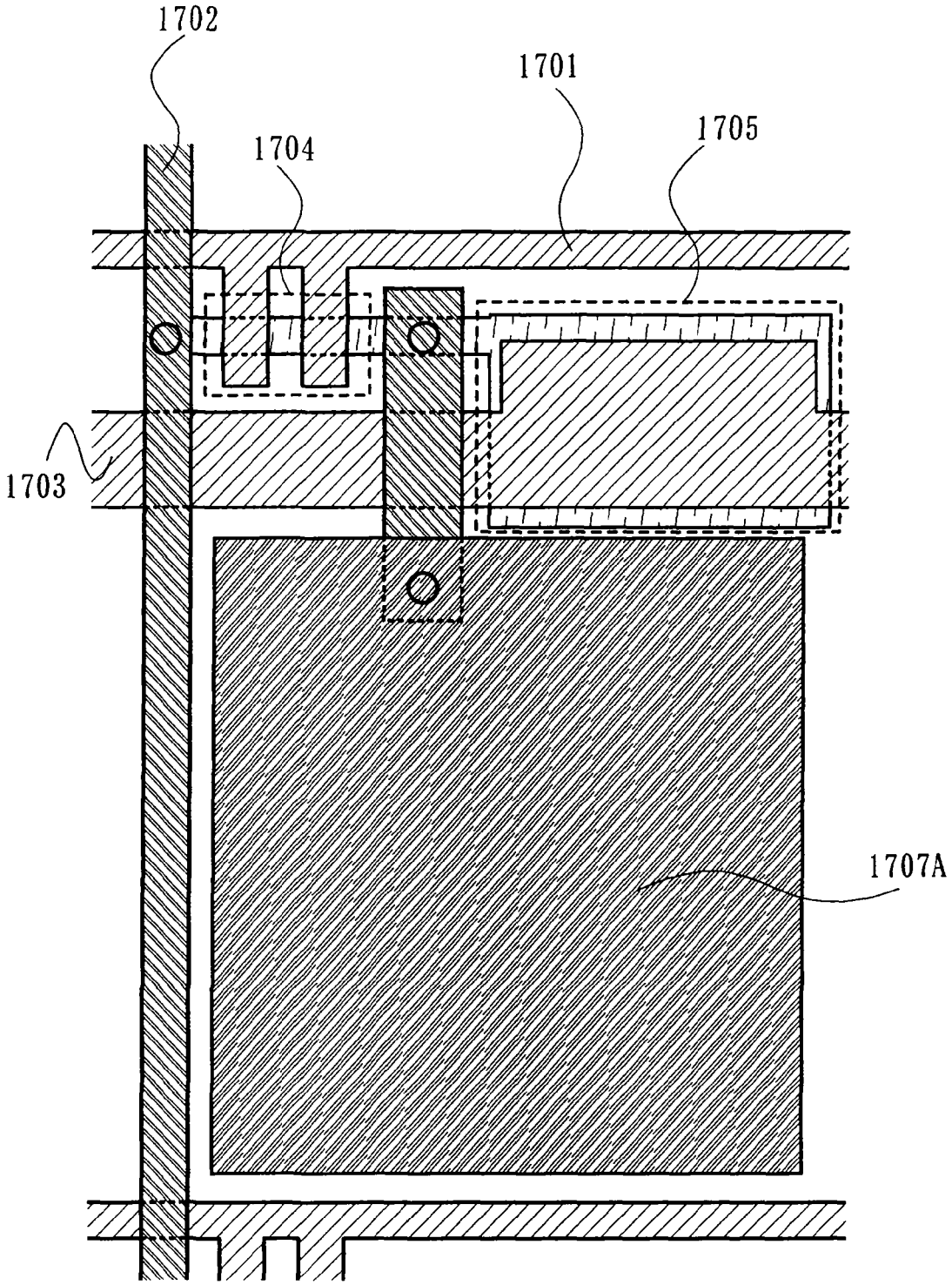
FIG. 17 is a diagram showing a structure of a display device of the invention.

Next, a layout of a pixel in a display device of the invention is described. For example, FIG. 17 shows a layout diagram of the circuit shown in FIG. 15. Note that a circuit diagram and a layout diagram are not limited to FIG. 15 and FIG. 17.

The selection transistor 1704, a pixel electrode 1707A of the liquid crystal element 1707, and the storage capacitor 1705 are provided. A source and a drain of the selection transistor 1704 are connected to the source signal line 1702 and the pixel electrode 1707A of the liquid crystal element 1707, respectively. A gate of the selection transistor 1704 is connected to the gate signal line 1701. The storage capacitor 1705 is provided using the electrode 1703.

The source signal line 1702 is formed of a second wire while the gate signal line 1701 is formed of a first wire.

In a case of a top gate structure, a film is composed by forming a substrate, a semiconductor layer, a gate insulating film, a first wire, an interlayer insulating film, and a second wire in this order. In a case of a bottom gate structure, a film is composed by forming a substrate, a first wire, a gate insulating film, a semiconductor layer, an interlayer insulating film, and a second wire in this order.

Figure 10:
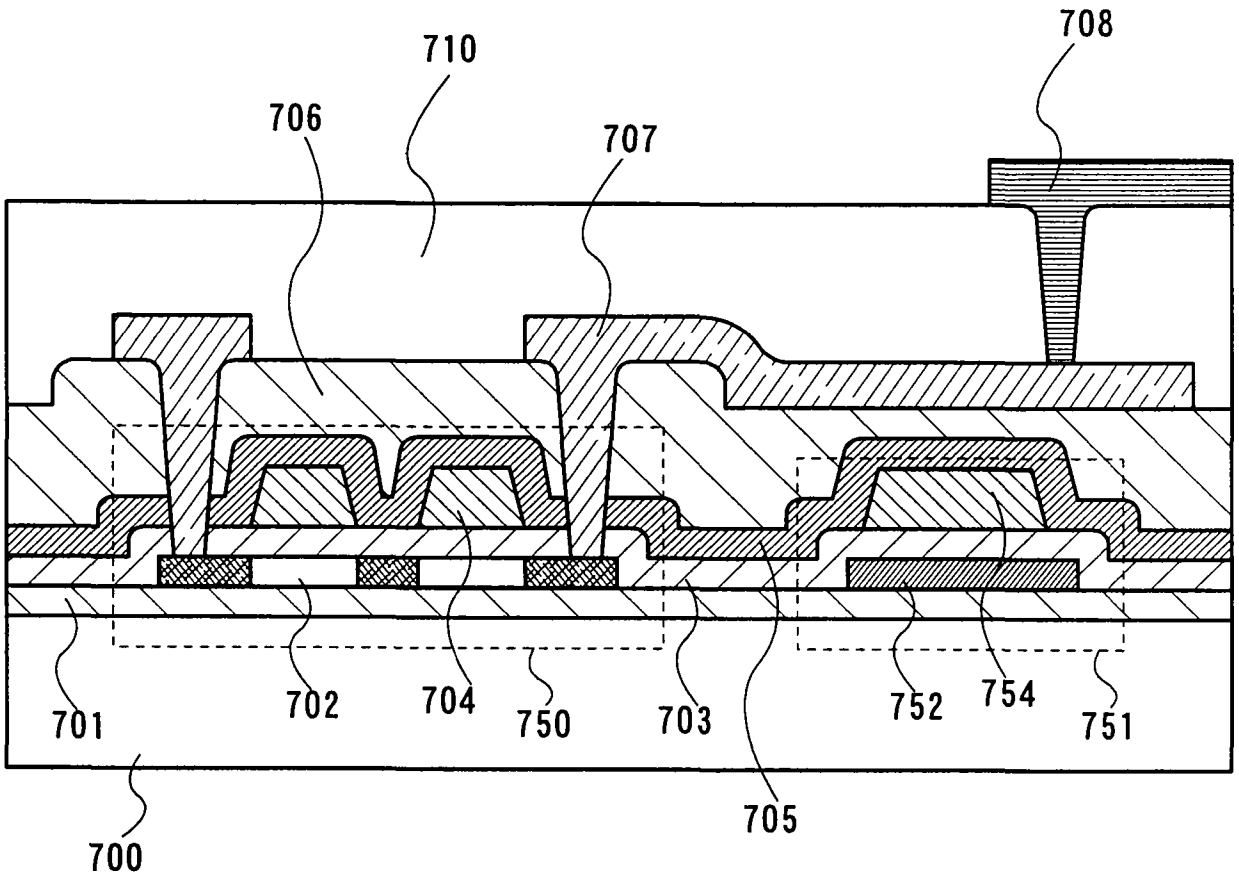
FIG. 10 is a diagram showing a structure of a display device of the invention.

Next, FIG. 10 is a cross-sectional view of a pixel composed of a thin film transistor (TFT) and a liquid crystal element connected thereto.

In FIG. 10, a base layer 701, a semiconductor layer 702 forming a TFT 750, and a semiconductor layer 752 forming one electrode of a capacitor 751 are formed on a substrate 700. A first insulating layer 703 is formed on the layers, the TFT 750 functions as a gate insulating layer, and the capacitor 751 functions as a dielectric layer for forming capacitance.

A gate electrode 704, and a conductive layer 754 forming the other electrode of the capacitor 751 are formed on the first insulating layer 703. A wire 707 connected to the TFT 750 is connected to a first electrode 708 of a liquid crystal element. This wire 707 is formed on a third insulating layer 706. Then, the first electrode 708 is formed on a fourth insulating layer 710. A second insulating layer 705 may be formed between the first insulating layer 703 and the third insulating layer 706. The liquid crystal element is provided between the first electrode 708 and a second electrode which is a counter electrode.

Next, details of the structure shown above are described. As the substrate 700, for example, a glass substrate such as barium borosilicate glass or alumino borosilicate glass, a quartz substrate, a ceramic substrate, or the like can be used. Moreover, an insulating film formed on a surface of a metal substrate including stainless or a semiconductor substrate may also be used. A substrate formed of a synthetic resin having flexibility such as plastic may be used as well. A surface of the substrate 700 may be planarized in advance by polishing such as chemical mechanical polishing (CMP).

An insulating film such as silicon oxide, silicone nitride, or silicon nitride oxide can be used as the base layer 701. The base layer 701 can prevent an alkaline metal such as Na or an alkaline earth metal included in the substrate 700 from diffusing to the semiconductor layer 702 and adversely affecting characteristics of the TFT 750. In FIG. 10, the base layer 701 has a single-layer structure; however may be formed of a plurality of layers. Note that a case where diffusion of an impurity from a quartz substrate or the like is not become a big problem, the base layer 701 is not necessarily provided.

Moreover, a surface of a glass substrate may be processed directly by high density plasma excited by a microwave, in which an electron temperature is 2 eV or less, an ion energy is 5 eV or less, and an electron density is about $10^{11}$ to $10^{13}/cm^3$. A plasma treatment apparatus of microwave excitation using a radial slot antenna can be used as plasma generation. At this time, when nitride gas such as nitrogen ($N_2$), ammonia ($NH_3$), or nitrous oxide ($N_2O$) is introduced, the surface of the glass substrate can be nitrided. A nitride layer formed on the surface of this glass substrate can be used as a blocking layer of an impurity diffusing from the glass substrate side since silicone nitride is contained as a main component. A silicon oxide film or a silicon oxynitride film may be formed on this nitride layer by plasma CVD to be the base layer 701.

In addition, by performing similar plasma treatment to the surface of the base layer 701 formed of silicon oxide, silicon oxynitride, or the like, nitriding treatment can be performed to the surface and in a depth of 1 to 10 nm from the surface. This extremely thin silicone nitride layer can be set a blocking layer which does not affect stress on a semiconductor layer formed thereon.

A patterned crystalline semiconductor film is preferably used as the semiconductor layer 702 and the semiconductor layer 752. Note that patterning means that a shape of a film is processed. In other words, the patterning means that a film pattern is formed by a photolithography technique (for example, including the formation of a contact hole in photosensitive acrylic, and processing the shape of photosensitive acrylic to be a spacer), a mask pattern is formed by a photolithography technique, an etching process is performed using the mask pattern, or the like. A crystalline semiconductor film can be obtained by crystallizing an amorphous semiconductor film. As a crystallization method, a laser crystallization method, a thermal crystallization method using RTA or an annealing furnace, a thermal crystallization method using a metal element to promote crystallization, or the like can be used. The semiconductor layer 702 includes a channel forming region and a pair of impurity regions which is doped with an impurity element imparting one conductive. Note that an impurity region which is doped with the impurity element at a low concentration may be formed between the channel forming region and the pair of impurity regions. A structure in which the entire semiconductor layer 752 is doped with an impurity element imparting one conductive or an opposite conductive type can be employed.

A single layer or a plurality of stacked films can be used to form the first insulating layer 703 using silicon oxide, silicone nitride, silicon nitride oxide, or the like. In this case, similarly as mentioned above, a surface of the insulating film may be oxidized or nitrided by high density plasma excited by a microwave, in which an electron temperature is 2 eV or less, an ion energy is 5 eV or less, and an electron density is about $10^{11}$ to $10^{13}/cm^3$, so as to be densified. This process may be performed before film formation of the first insulating layer 703. That is, plasma treatment may be performed to a surface of the semiconductor layer 702. At this time, a favorable boundary with a gate insulating layer stacked thereon can be formed by processing with a substrate temperature of 300 to 450° C. in an oxidation atmosphere ($O_2$, $N_2O$, or the like) or a nitrogen atmosphere ($N_2$, $NH_3$, or the like).

The gate electrode 704 and the conductive layer 754 can be formed using a single-layer or a stack structure formed of an element selected from Ta, W, Ti, Mo, Al, Cu, Cr, or Nd, or an alloy or a compound including a plurality of the elements.

The TFT 750 is composed of the semiconductor layer 702, the gate electrode 704, and the first insulating film 703 between the semiconductor layer 702 and the gate electrode 704. In FIG. 10, the TFT 750 connected to the first electrode 708 of the liquid crystal element is shown as the TFT for forming the pixel. This TFT 750 shows a multi-gate structure in which a plurality of gate electrodes 704 is provided on the semiconductor layer 702. That is, there is a structure in which a plurality of TFTs is connected in series. Such a structure can suppress the increase of unprepared off current. Note that in FIG. 10, although a top-gate TFT is shown as the TFT 750, the TFT 750 may be a bottom-gate TFT where a gate electrode is provided below a semiconductor layer as well as a dual-gate TFT where gate electrodes are provided above and below a semiconductor layer.

The capacitor 751 is formed of the first insulating film 703 as a dielectric, and the semiconductor layer 752 and the conductive layer 754 as a pair of electrodes facing each other sandwiching the first insulating film 703. Note that FIG. 10 shows an example in which as the capacitors provided in the pixel, the semiconductor layer 752 formed at the same time with the semiconductor layer 702 of the TFT 750 is used as one of the pair of electrodes, and the conductive layer 754 formed at the same time with the gate electrode 704 is used as the other electrode; however, the invention is not limited to this.

Preferably, the second insulating layer 705 is an insulating film having barrier properties such as a silicon nitride film, which blocks an ion impurity. The second insulating layer 705 is formed of silicon nitride or silicon oxynitride. The second insulating layer 705 has a function as a protective film for preventing contamination of the semiconductor layer 702. After the second insulating layer 705 is stacked, hydrogenation of the second insulating layer 705 may be performed by introducing hydrogen gas and performing the high density plasma treatment in which the plasma is excited by microwave as described above. Further, ammonia gas is introduced, and nitriding and hydrogenation of the second insulating layer 705 may be performed. Further, oxygen, $N_2O$ gas, or the like, and hydrogen gas are introduced, and oxynitriding treatment and hydrogenation may be performed. In accordance with this method, a surface of the second insulating layer 705 can be densified by performing nitriding treatment, oxidation treatment, or oxynitriding treatment. Accordingly, a function as a protective film can be strengthened. Hydrogen introduced in the second insulating layer 705 is released from silicon nitride which forms the second insulating layer 705 by heat treatment at 400 to 450° C.; accordingly, the semiconductor layer 702 can be hydrogenated.

For the third insulating layer 706, inorganic insulating film or an organic insulating film can be used. A silicon oxide film formed by CVD, an SOG (Spin On Glass) film (coated silicon oxide film), or the like can be used as the inorganic insulating film. A film of polyimide, polyamide, BCB (benzocyclobutene), acrylic, a positive photosensitive organic resin, a negative photosensitive organic resin, or the like can be used as the organic insulating film. Moreover, a material having a skeleton structure formed by the bond of silicon (Si) and oxygen (O) can be used as the third insulating layer 706. An organic group containing at least hydrogen (such as an alkyl group or aromatic hydrocarbon) is included as a substituent. Alternatively, a fluoro group may be used as the substituent. Further, alternatively, a fluoro group and an organic group containing at least hydrogen may be used as the substituent.

The wire 707 can be formed using a single-layer or a stack structure formed of an element selected from Al, Ni, C, W, Mo, Ti, Pt, Cu, Ta, Au, or Mn or an alloy containing a plurality of the elements.

One or both of the first electrode 708 and the second electrode can be set a transparent electrode. The transparent electrode can be formed using indium oxide containing tungsten oxide (IWO), indium zinc oxide containing tungsten oxide (IWZO), indium oxide containing titanium oxide (ITiO), indium tin oxide containing titanium oxide (ITTiO), indium tin oxide containing molybdenum (ITMO), or the like. Of course, indium tin oxide (ITO), indium zinc oxide (IZO), indium tin oxide in which silicon oxide is added (ITSO), or the like can be also used.

One portion of the first electrode 708 may be formed of a material without light transmissivity. For example, an alkaline metal such as Li or Cs, an alkaline earth metal such as Mg, Ca or Sr, an alloy containing such metals (Mg:Ag, Al:Li, Mg:In, or the like), a compound of such metals ($CaF_2$, $Ca_3N_2$, or the like), or a rare earth metal such as Yb or Er can be used.

A fourth insulating layer 712 can be formed of a similar material to that of the third insulating layer 706.

By combining a pixel of a structure shown in FIG. 10 and an external light intensity detecting means, an orientation state of liquid crystal molecules in a liquid crystal element is changed, an amount of light for passing through the liquid crystal element is controlled, and luminance of a display screen can be controlled.

Note that a transistor may be formed using amorphous silicon as well as polysilicon for a semiconductor layer.

Figure 12:
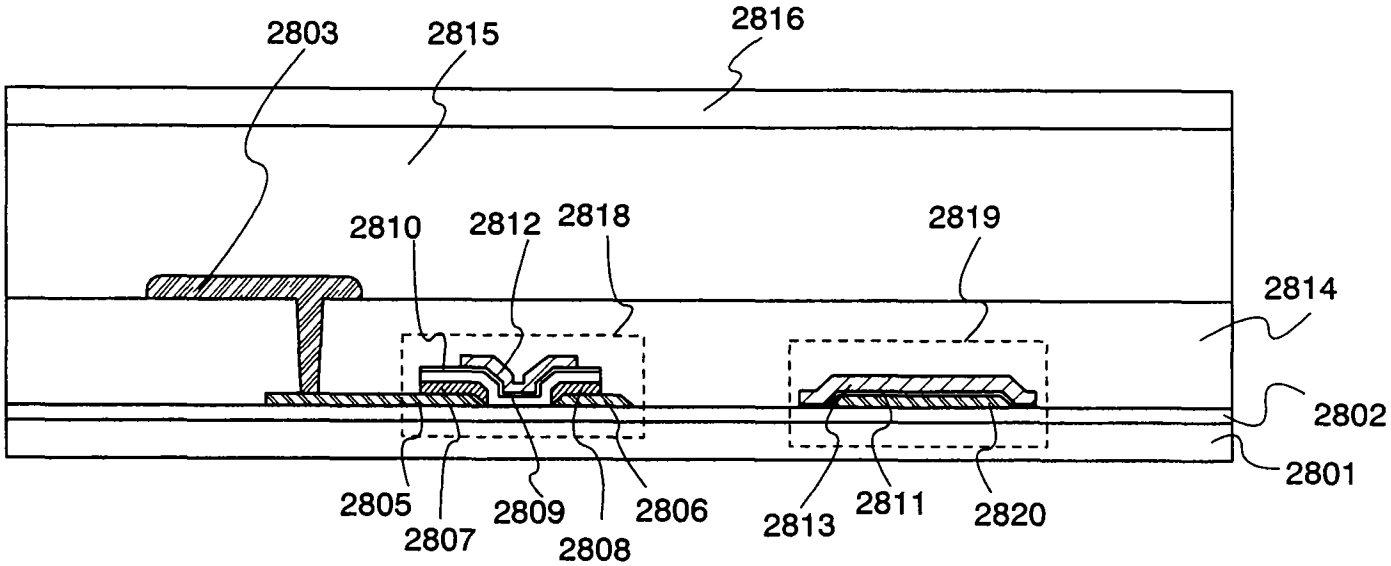
FIG. 12 is a diagram showing a structure of a display device of the invention.
Figure 13:
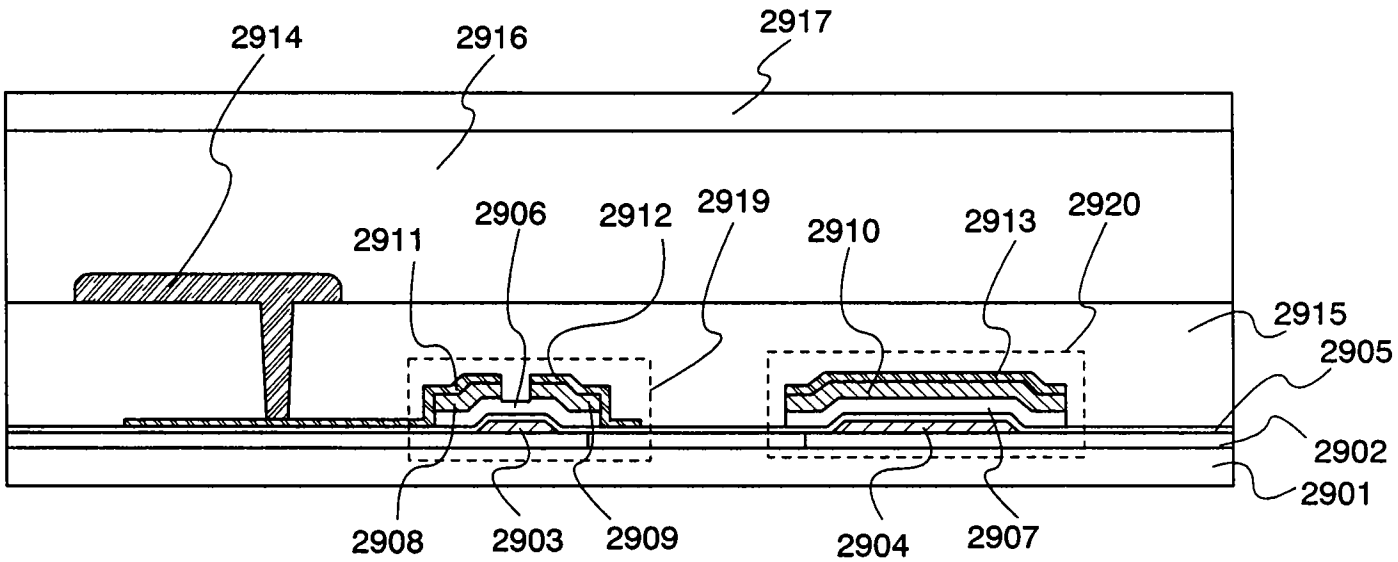
FIG. 13 is a diagram showing a structure of a display device of the invention.
Figure 35:
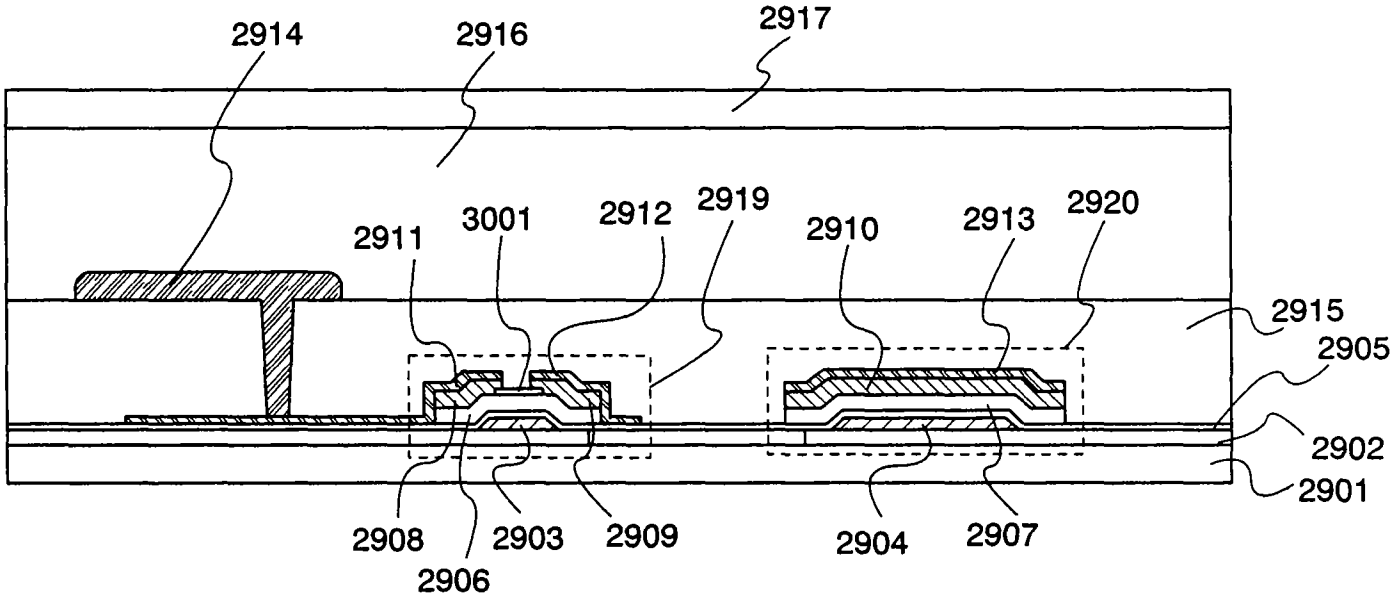
FIG. 35 is a diagram showing a structure of a display device of the invention.

Next, a case where amorphous silicon (a-Si: H) film is used as a semiconductor layer of a transistor is described. FIG. 12 shows a case of a top gate transistor, and FIG. 13 and FIG. 35 show a case of a bottom gate transistor.

FIG. 12 shows a cross section of a top gate transistor in which amorphous silicon is used as a semiconductor layer. A base film 2802 is formed on a substrate 2801 as shown in FIG. 12. Moreover, a first electrode 2820 composed of the same material is formed on the base film 2802.

A glass substrate, a quartz substrate, a ceramic substrate, or the like can be used as the substrate. Moreover, the base film 2802 can be formed using a single layer of aluminum nitride (AlN), silicon oxide ($SiO_2$), silicon oxynitride ($SiO_xN_y$), or the like or a stacked layer thereof.

Moreover, a wire 2805 and a wire 2806 are formed on the base film 2802. An N-type semiconductor layer 2807 and an N-type semiconductor layer 2808 each having N-type conductivity are formed on the wire 2805 and the wire 2806, respectively. Moreover, a semiconductor layer 2809 is formed on the base film 2802 and between the wire 2806 and the wire 2805. In addition, one portion of the semiconductor layer 2809 is extended to the N-type semiconductor layer 2807 and the N-type semiconductor layer 2808. Note that this semiconductor layer is formed of a semiconductor film having an amorphous property such as amorphous silicon (a-Si: H), or a microcrystalline semiconductor (μ-Si: H). A gate insulating film 2810 is formed on the semiconductor layer 2809. An insulating film 2811 formed of the same material in the same layer as the gate insulating film 2810 is formed on the first electrode 2820. Note that a silicon oxide film, a silicon nitride film, or the like is used as the gate insulating film 2810.

In addition, a gate electrode 2812 is formed on the gate insulating film 2810. A second electrode 2813 formed of the same material in the same layer as the gate electrode is formed on the first electrode 2820 with the insulating film 2811 interposed therebetween. A capacitor 2819 is formed by sandwiching the insulating film 2811 between the first electrode 2820 and the second electrode 2813. In addition, an interlayer insulating film 2814 is formed to cover an end portion of a pixel electrode 2803, a driving transistor 2818, and the capacitor 2819.

A liquid crystal layer 2815 and a counter electrode 2816 are formed on the pixel electrode 2803 which is on the interlayer insulating film 2814, and the liquid crystal layer 2815 is sandwiched between the pixel electrode 2803 and the counter electrode 2816.

Moreover, the first electrode 2820 is formed of the same material in the same layer as the wires 2805 and 2806.

Moreover, FIG. 13 shows a partial cross section of a panel of a display device using a bottom gate transistor in which amorphous silicon is used as a semiconductor layer.

A base film 2902 is formed on a substrate 2901. Furthermore, a gate electrode 2903 is formed on the base film 2902. Moreover, a first electrode 2904 is formed of the same material in the same layer as the gate electrode. Phosphorus-added polycrystalline silicon can be used as a material of the gate electrode 2903. Other than phosphorus-added polycrystalline silicon, silicide that is a compound of metal and silicon may be used as well.

Moreover, a gate insulating film 2905 is formed so as to cover the gate electrode 2903 and the first electrode 2904. The gate insulating film 2905 is formed using a silicon oxide film, a silicon nitride film, or the like.

Further, a semiconductor layer 2906 is formed on the gate insulating film 2905. In addition, a semiconductor layer 2907 is formed of the same material in the same layer as the semiconductor layer 2906.

A glass substrate, a quartz substrate, a ceramic substrate, or the like can be used as the substrate. Moreover, the base film 2902 can be formed using a single layer of aluminum nitride (AlN), silicon oxide ($SiO_2$), silicon oxynitride ($SiO_xN_y$) or the like, or a stacked layer thereof.

N-type semiconductor layers 2908 and 2909 each having N-type conductivity are formed on the semiconductor layer 2906, and an N-type semiconductor layer 2910 is formed on the semiconductor layer 2907.

Wires 2911 and 2912 are formed on the N-type semiconductor layers 2908 and 2909, respectively, and a conductive layer 2913 formed of the same material in the same layer as the wires 2911 and 2912 is formed on the N-type semiconductor layer 2910.

A second electrode is composed of the semiconductor layer 2907, the N-type semiconductor layer 2910, and the conductive layer 2913. Note that a capacitor 2920 having a structure sandwiching the gate insulating film 2905 between the second electrode and the first electrode 2904 is formed.

Moreover, one end of the wire 2911 is extended, a contact hole is formed on the extended wire 2911, and a pixel electrode 2914 is formed.

Moreover, an insulator 2915 is formed so as to cover a driving transistor 2919 and the capacitor 2920.

The pixel electrode 2914, a liquid crystal layer 2916, and a counter electrode 2917 are formed on the insulator 2915, and the liquid crystal layer 2916 is sandwiched between the pixel electrode 2914 and the counter electrode 2917.

The semiconductor layer 2907 and the N-type semiconductor layer 2910 which are to be one portion of the second electrode of the capacitor are not required to be provided. That is, the conductive layer 2913 may serve as the second electrode, and there may be a capacitor having a structure in which the gate insulating film is sandwiched between the first electrode 2904 and the conductive layer 2913.

Note that FIG. 13 shows an inversely-staggered transistor of a channel etch type; however, it is needless to say that a channel protective type transistor may be used. A case of a channel protective type transistor is described with reference to FIG. 35.

A channel protective type transistor shown in FIG. 35 is different from the driving transistor of the channel etch type 2919 shown in FIG. 13 in that an insulator 3001 which serves as an etching mask is provided on the channel forming region in the semiconductor layer 2906. The other portions identical to FIG. 13 are denoted by the same reference numerals.

By using an amorphous semiconductor film as a semiconductor layer (a channel forming region, a source region, a drain region, or the like) of a transistor constituting the pixel of the invention, manufacturing cost can be reduced. For example, by using various pixel configurations, an amorphous semiconductor film can be applied.

Note that a structure of a transistor and a structure of a capacitor applicable to the pixel configuration of the invention are not limited to the aforementioned structures, and various structures can be used.

Note that a content described in this embodiment mode can be implemented by freely combining with the content described in Embodiment Modes 1 to 4.

(Embodiment Mode 6)

An optical sensor for detecting external light intensity may be incorporated in one portion of a display device. This optical sensor may be mounted as a part on a display device, or may be integrally formed on a display panel. In the case of being formed integrally on a display panel, a display surface can be used together as a light receiving surface of an optical sensor to have a beneficial effect on design. That is, without being recognized that an optical sensor is attached to the display device, gradation control based on the external light intensity can be performed.

Figure 11:
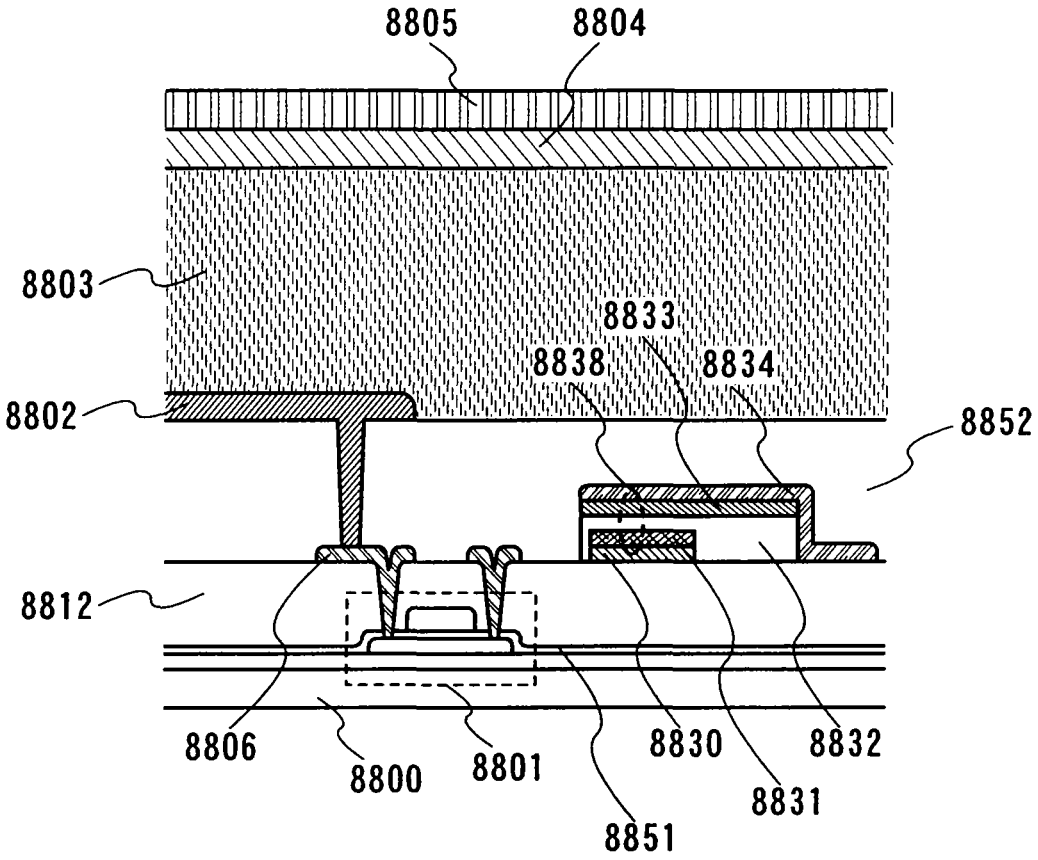
FIG. 11 is a diagram showing a structure of a display device of the invention.

FIG. 11 is a diagram showing one mode to form an optical sensor integrally on a display panel. Note that FIGS. 8A and 8B show a case of forming a pixel with a liquid crystal element and a TFT controlling the operation thereof.

In FIG. 11, a switching TFT 8801, a first electrode (pixel electrode) 8802 formed of a light transmissive material, a liquid crystal 8803, a second electrode (counter electrode) 8804 formed of a light transmissive material on a counter substrate 8805 are provided on a substrate 8800 having light transmissivity. In addition, a wire 8806 is formed on an insulating film 8812. Similarly, a p-type layer 8831, a photoelectric converter 8838 composing a stack of a substantially intrinsic i-type layer 8832 and an n-type layer 8833, an electrode 8830 connected to the p-type layer 8831, and an electrode 8834 connected to the n-type layer 8833 are provided on the insulating film 8812. Note that the photoelectric converter 8838 may be formed in the same layer as the wire 8806, that is, on the insulating film 8812. The photoelectric converter 8838 may be formed in the same layer as the first electrode (pixel electrode) 8802, that is, on an insulating film 8851. The photoelectric converter 8838 may be formed in the same layer as the gate wire, that is, on an insulating film 8852.

The photoelectric converter 8838 is used as an optical sensor element in this embodiment. The photoelectric converter 8838 is formed on the same substrate 8800, light passing through the liquid crystal 8803 forms an image, and a user visually identifies. On the other hand, the photoelectric converter detects external light and has a role to transmit a detection signal to a controller. In this manner, the liquid crystal element and the optical sensor (photoelectric converter) can be formed on the same substrate to contribute to downsizing of a set.

Note that a content described in this embodiment mode can be implemented by freely combining with the content described in Embodiment Modes 1 to 5.

(Embodiment Mode 6)

This embodiment mode describes hardware for controlling the display device described in Embodiment Modes 1 to 5.

Figure 18:
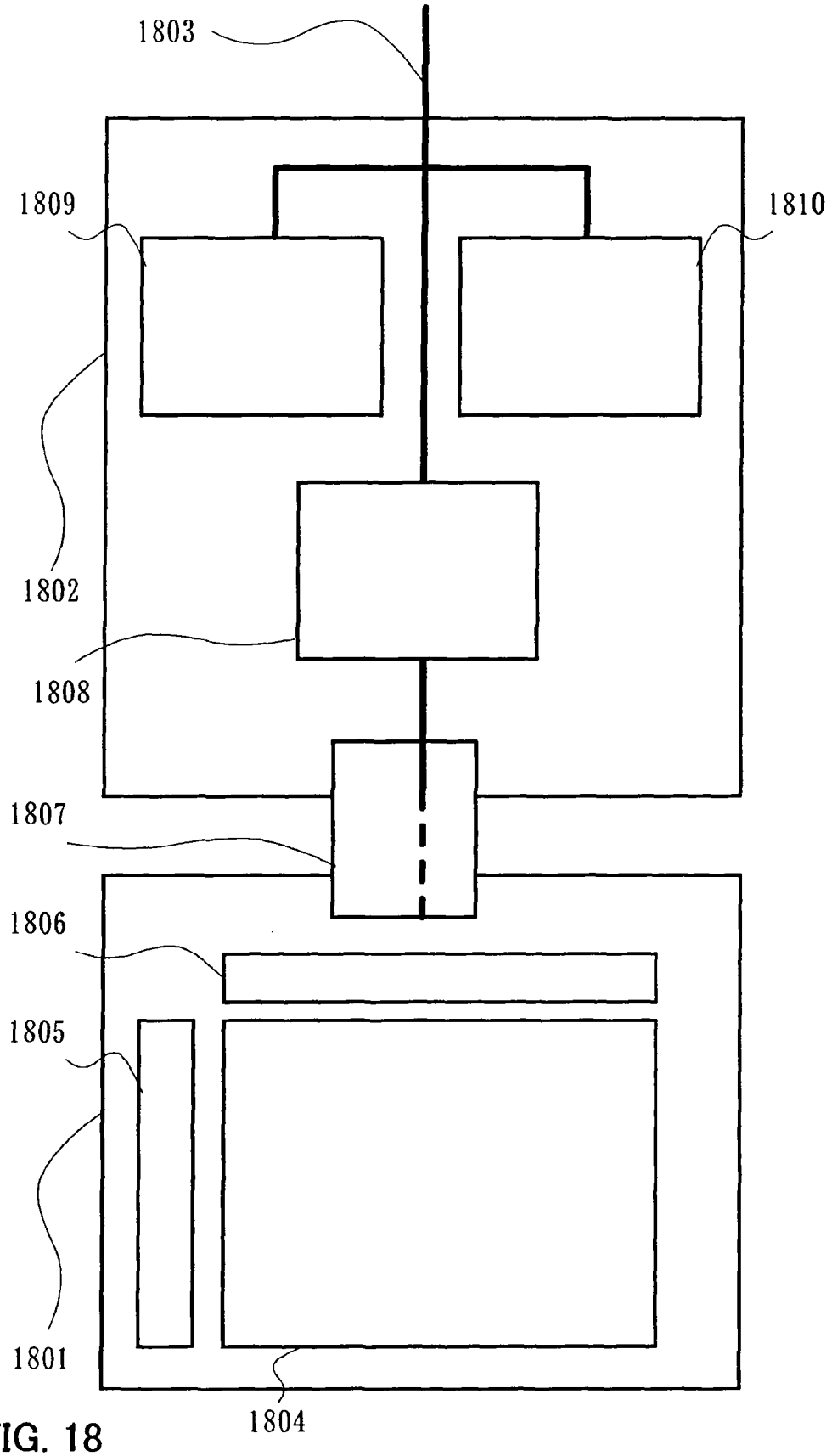
FIG. 18 is a diagram showing a structure of a display device of the invention.

FIG. 18 is a rough configuration view. A pixel array 1804 is provided on a substrate 1801. There are many cases in which a source driver 1806 or a gate driver 1805 is provided. Besides, a power supply circuit, a pre-charge circuit, a timing generation circuit, or the like may be provided. Moreover, there is a case where the source driver 1806 or the gate driver 1805 is not provided. In that case, there are many cases in which a driver which is not provided on the substrate 1801 is formed on an IC. There are many cases in which the IC is provided on the substrate 1801 by COG (Chip On Glass). Alternatively, there is a case where the IC is provided on a connection substrate 1807 which connects a peripheral circuit substrate 1802 and the substrate 1801.

A signal 1803 is inputted to the peripheral circuit substrate 1802. Then, a controller 1808 controls memories and a signal is stored in a memory 1809, a memory 1810, or the like. In a case where the signal 1803 is an analog signal, there are many cases where the signal is stored in the memory 1809, the memory 1810, or the like after analog-digital conversion is performed. Then, the controller 1808 uses the signal stored in the memory 1809, the memory 1810, or the like, and outputs the signal to the substrate 1801.

The controller 1808 controls various pulse signals or the like and outputs the signal to the substrate 1801 in order to realize the driving method described in Embodiment Modes 1 to 5.

Note that a content described in this embodiment mode can be implemented by freely combining with the content described in Embodiment Modes 1 to 6.

(Embodiment Mode 7)

Figure 19:
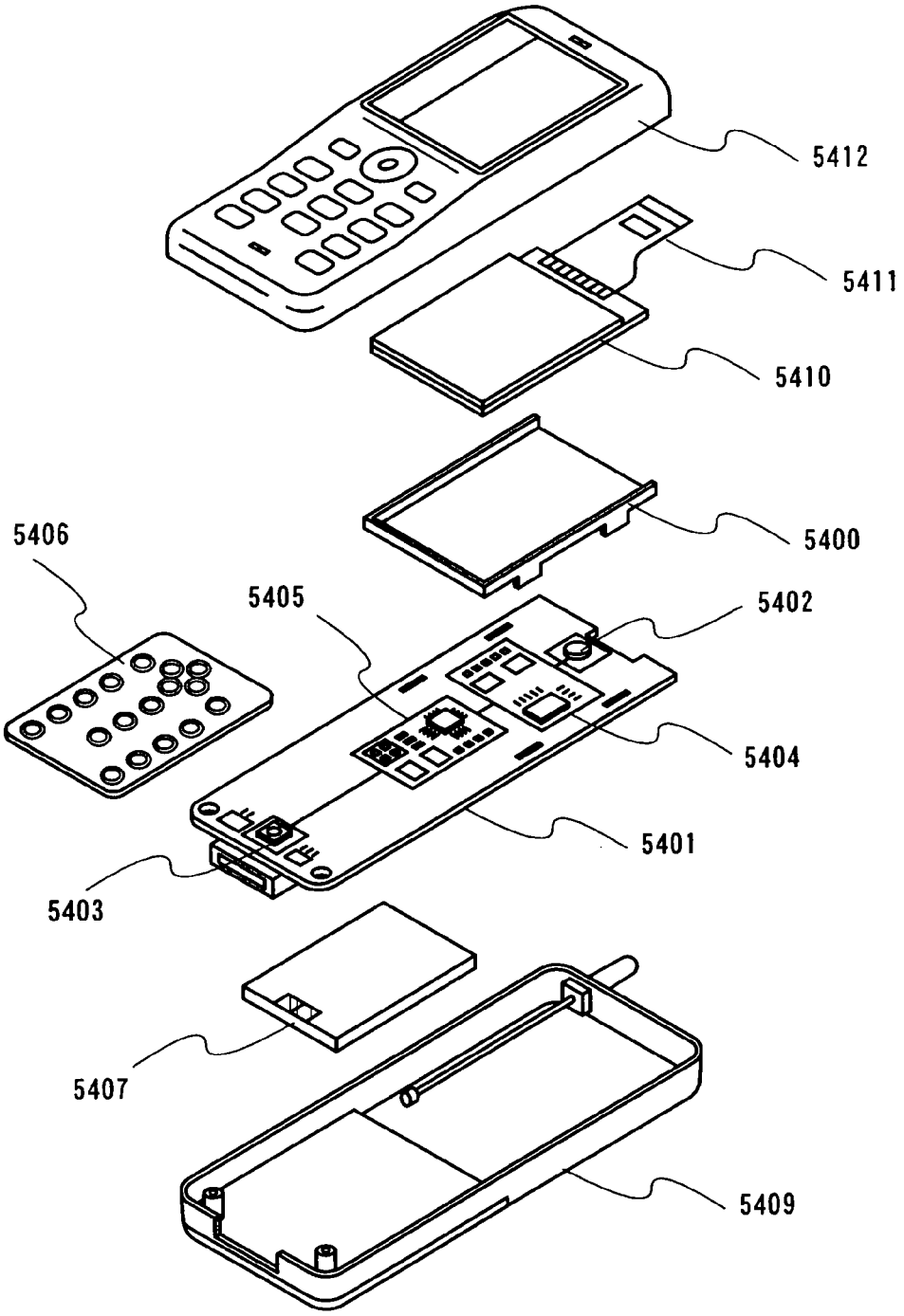
FIG. 19 is a diagram showing an electronic apparatus to which the invention is applied.

A structural example of a mobile phone having the display device of the invention or a display device using a driving method thereof in a display portion is described with reference to FIG. 19.

A display panel 5410 is detachably incorporated in a housing 5400. The shape and the size of the housing 5400 can be changed appropriately in accordance with the size of the display panel 5410. The housing 5400 to which the display panel 5410 is fixed is fitted in a printed substrate 5401 to be constructed as a module.

The display panel 5410 is connected to the printed substrate 5401 through an FPC 5411. A speaker 5402, a microphone 5403, a transmission/reception circuit 5404, a signal processing circuit 5405 including a CPU, a controller, and the like are formed on the printed substrate 5401. Such a module, an input means 5406, and a battery 5407 are combined to be incorporated in a chassis 5409. A pixel portion of the display panel 5410 is provided to be seen from an opening window of the chassis 5409.

Figure 20B:
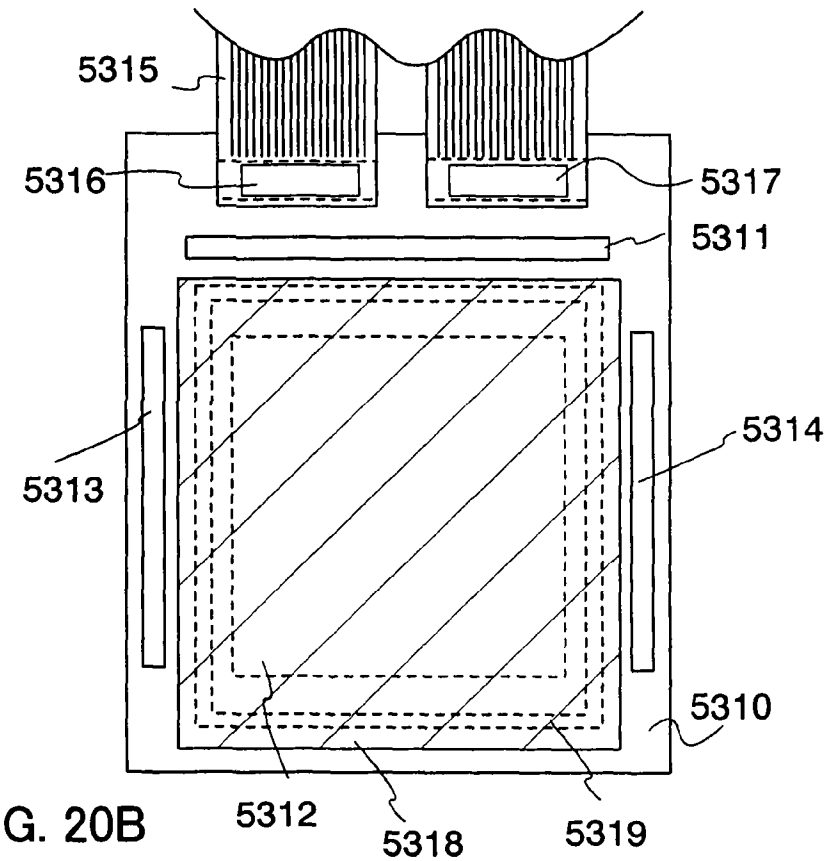
FIGS. 20A and 20B are diagrams each showing a structure of a display device of the invention.
Figure 20A:
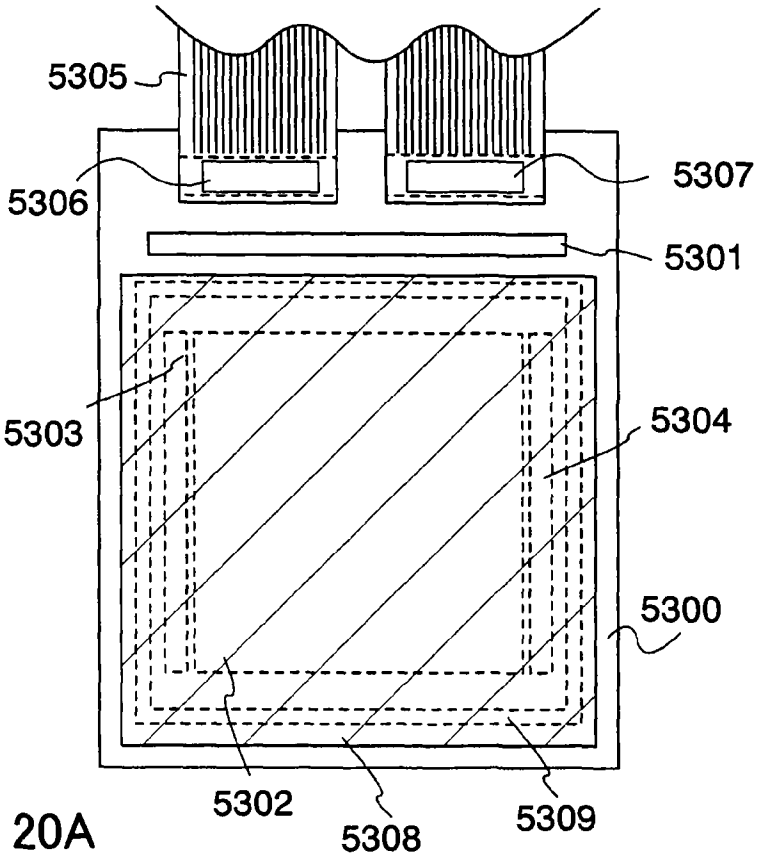

In the display panel 5410, a pixel portion and a part of a peripheral driver circuit (a driver circuit of which operation frequency is low among a plurality of driver circuits) may be integrally formed on the substrate using a TFT. Meanwhile, another part of the peripheral driver circuit (a driver circuit of which operation frequency is high among the plurality of driver circuits) may be formed on an IC chip, and the IC chip may be mounted on the display panel 5410 by COG (Chip On Glass). Further, the IC chip may be connected to a glass substrate by using TAB (Tape Auto Bonding) or a printed substrate. Note that FIG. 20*a* shows an example of a structure of a display panel where a part of a peripheral driver circuit and a pixel portion are integrally formed on a substrate, and an IC chip on which another peripheral driver circuit is formed is mounted thereon by COG or the like. By using such a structure, power consumption of a display device is achieved to be lowered and the operating time of a mobile phone by charging once can be extended. Moreover, cost reduction of the mobile phone can be achieved.

Moreover, by impedance converting a signal which is set to a scan line or a signal line by a buffer, a writing period of pixels of each row can be shortened. Therefore, a high definition display device can be provided.

Moreover, a pixel portion may be formed on a substrate using a TFT, all peripheral driver circuits may be formed on an IC chip, and then the IC chip may be mounted on a display panel by COG (Chip On Glass) or the like, in order to decrease power consumption further.

By using the display device of the invention, a clear image with high contrast can be displayed.

Moreover, a structure described in this embodiment mode is an example of a mobile phone so that the display device of the invention can be applied to various mobile phones without limiting to such a structure of the mobile phone.

Note that a content described in this embodiment mode can be implemented by freely combining with the content described in Embodiment Modes 1 to 7.

(Embodiment Mode 8)

Figure 21:
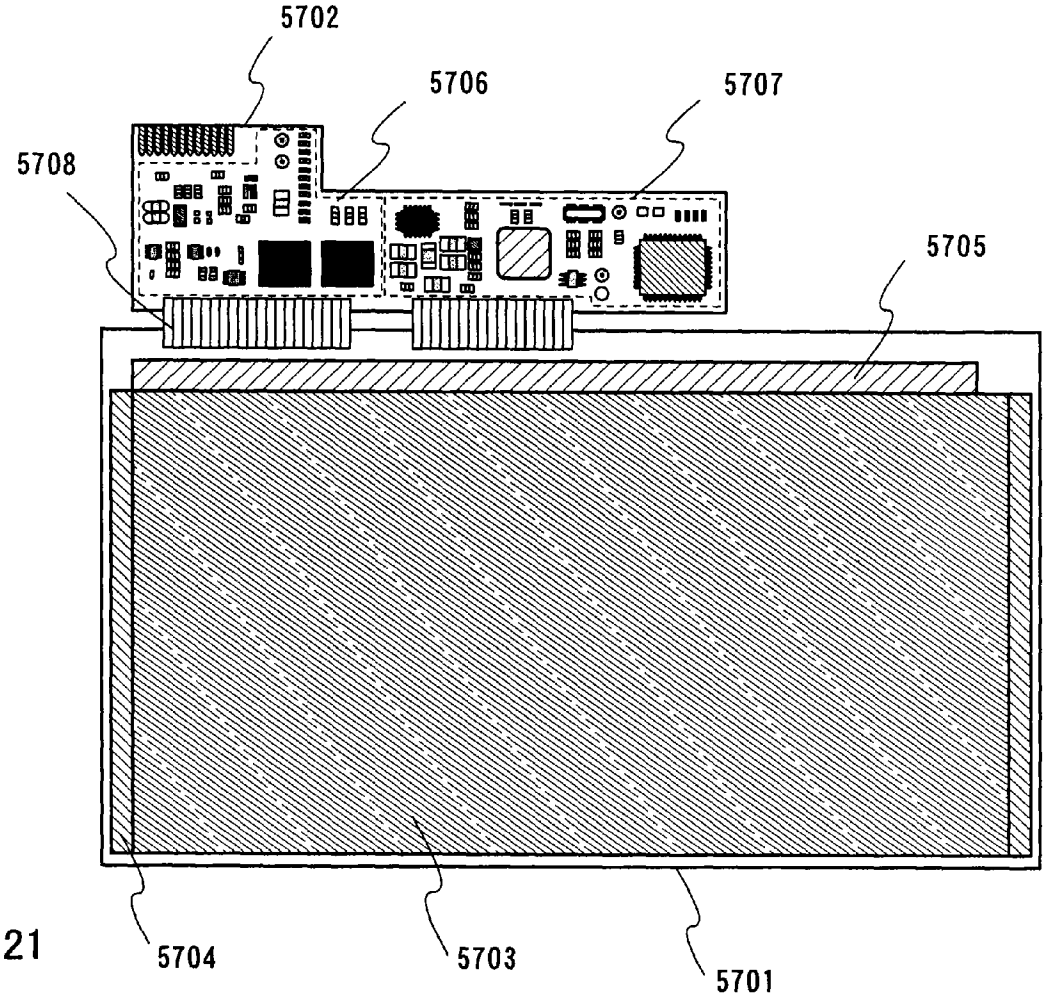
FIG. 21 is a diagram showing a structure of a display device of the invention.

FIG. 21 shows an EL module formed by combining a display panel 5701 and a circuit substrate 5702. The display panel 5701 includes a pixel portion 5703, a scan driver circuit 5704, and a signal driver circuit 5705. For example, a control circuit 5706, a signal dividing circuit 5707, and the like are formed on the circuit substrate 5702. The display panel 5701 is connected to the circuit substrate 5702 with a connection wire 5708. An FPC or the like can be used as the connection wire.

The control circuit 5706 corresponds to the controller 1808, the memory 1809, the memory 1810, or the like in Embodiment Mode 7. Mainly, the control circuit 5706 controls the appearance order of subframes, or the like.

In the display panel 5701, a pixel portion and a part of a peripheral driver circuit (a driver circuit of which operation frequency is low among a plurality of driver circuits) may be integrally formed on the substrate using a TFT. Meanwhile, another part of the peripheral driver circuit (a driver circuit of which operation frequency is high among the plurality of driver circuits) may be formed on an IC chip, and the IC chip may be mounted on the display panel 5701 by COG (Chip On Glass) or the like. Further, the IC chip may be mounted on the display panel 5701 by using TAB (Tape Auto Bonding) or a printed substrate. Note that FIG. 20*a* shows an example of a structure where the part of the peripheral driver circuit and the pixel portion are integrally formed on the substrate and the IC chip on which another part of the peripheral driver circuit is formed is mounted thereon by COG or the like. By using such a structure, power consumption of a display device is achieved to be lowered and the operating time of a mobile phone by charging once can be extended. Moreover, cost reduction of the mobile phone can be achieved.

Moreover, by impedance converting a signal which is set to a scan line or a signal line by a buffer, a writing period of pixels of each row can be shortened. Therefore, a high definition display device can be provided.

Moreover, a pixel portion may be formed on a glass substrate using a TFT, all signal line driver circuits may be formed on an IC chip, and then the IC chip may be mounted on a display panel by COG (Chip On Glass) or the like, in order to decrease power consumption further.

Note that a pixel portion may be formed on a substrate using a TFT, all peripheral driver circuits may be formed on an IC chip, and then the IC chip may be mounted on a display panel by COG (Chip On Glass) or the like. Note that FIG. 20*b* shows an example of a structure where a pixel portion is formed on a substrate and an IC chip on which a signal driver circuit is formed is mounted on the substrate by COG or the like.

Figure 22:
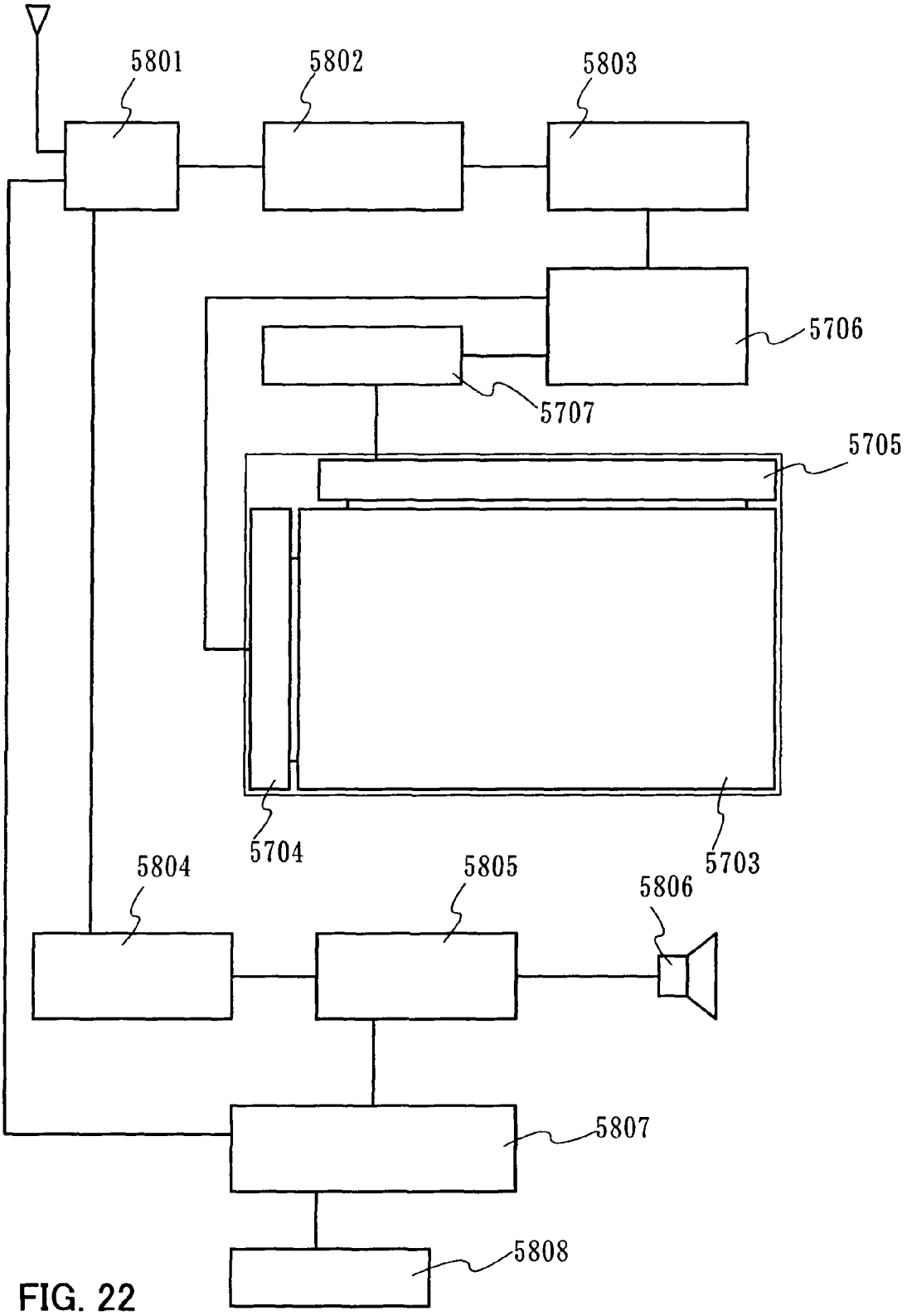
FIG. 22 is a diagram showing a structure of a display device of the invention.

A liquid crystal television receiver can be completed by using this liquid crystal module. FIG. 22 is a block diagram which shows a main structure of a liquid crystal television receiver. A tuner 5801 receives a video signal and an audio signal. The video signal is processed by a video signal amplifier circuit 5802, a video signal processing circuit 5803 for converting the signal outputted from the image signal amplifier circuit 5802 into color signals corresponding to each of red, green, and blue, and the control circuit 5706 for converting the image signal to be an input specification of a driver circuit. The control circuit 5706 outputs a signal to each of a scan line side and a signal line side. In a case of a digital driving, the signal dividing circuit 5707 may be provided at a signal line side so that an input digital signal may be divided into m signals to be supplied.

An audio signal among the signals received by the tuner 5801 is transmitted to an audio signal amplifier circuit 5804 and the output is supplied to a speaker 5806 through an audio signal processing circuit 5805. A control circuit 5807 receives control data such as a receiving station (received frequency) or volume from an input portion 5808, and transmits a signal to the tuner 5801 and the audio signal processing circuit 5805.

A liquid crystal module is incorporated in a chassis so as to complete a television receiver. With the liquid crystal module, a display portion can be formed. In addition, a speaker, a video input terminal, and the like are appropriately provided.

Of course, the invention is not limited to the television receiver and can be applied to various applications particularly as a large area display medium, such as a monitor of a personal computer, an information display board at a train station, airport, and the like, or an advertisement display board on the streets.

In this manner, by using the display device of the invention, a clear image with high contrast can be displayed.

Note that a content described in this embodiment mode can be implemented by freely combining with the content described in Embodiment Modes 1 to 8.

(Embodiment Mode 9)

This embodiment mode shows an example of an optical sensor and an amplifier.

Figure 34:
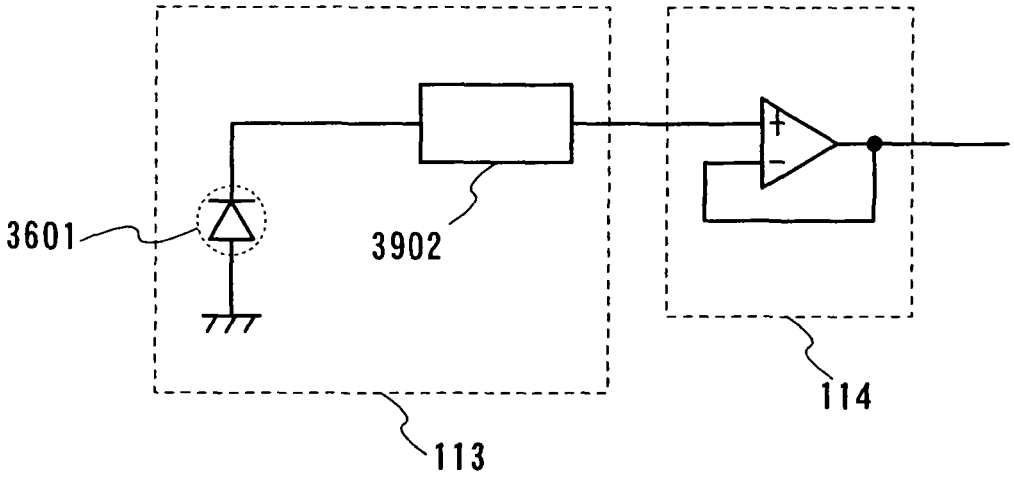
FIG. 34 is a diagram showing a structure of a display device of the invention.

FIG. 34 is a basic configuration view. A photoelectric converter 3601 is irradiated with light and a current flows in accordance with illuminance. The current is converted to a voltage signal in a current-voltage converter circuit 3902. In this manner, the optical sensor 113 is formed of the photoelectric converter 3601 and the current-voltage converter circuit 3902. Then, a signal outputted from the optical sensor 113 is inputted to the amplifier 114. FIG. 34 shows a voltage follower circuit using an operational amplifier. However, the invention is not limited to this.

Figure 31:
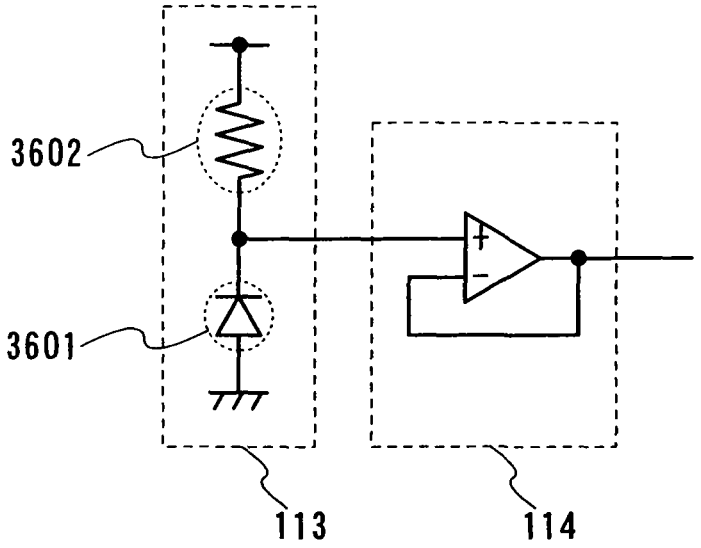
FIG. 31 is a diagram showing a structure of a display device of the invention.

A resistor 3602 may be used as an example of the current-voltage converter circuit 3902 as shown in FIG. 31. However, the invention is not limited to this. A circuit may be formed using an operational amplifier.

Figure 32:
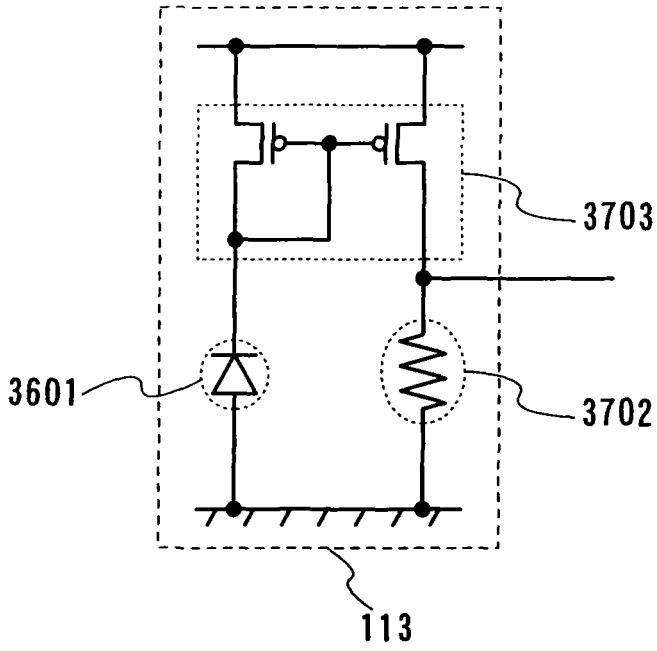
FIG. 32 is a diagram showing a structure of a display device of the invention.

In FIGS. 34 and 31, a current flowing to the photoelectric converter 3601 is used; however this current may be amplified. For example, as shown in FIG. 32, a current flowing to a resistor 3702 which is a current-voltage converter circuit may be increased using a current mirror circuit 3703. As a result, sensitivity to light improves and resistance properties for noise can be improved.

Figure 33:
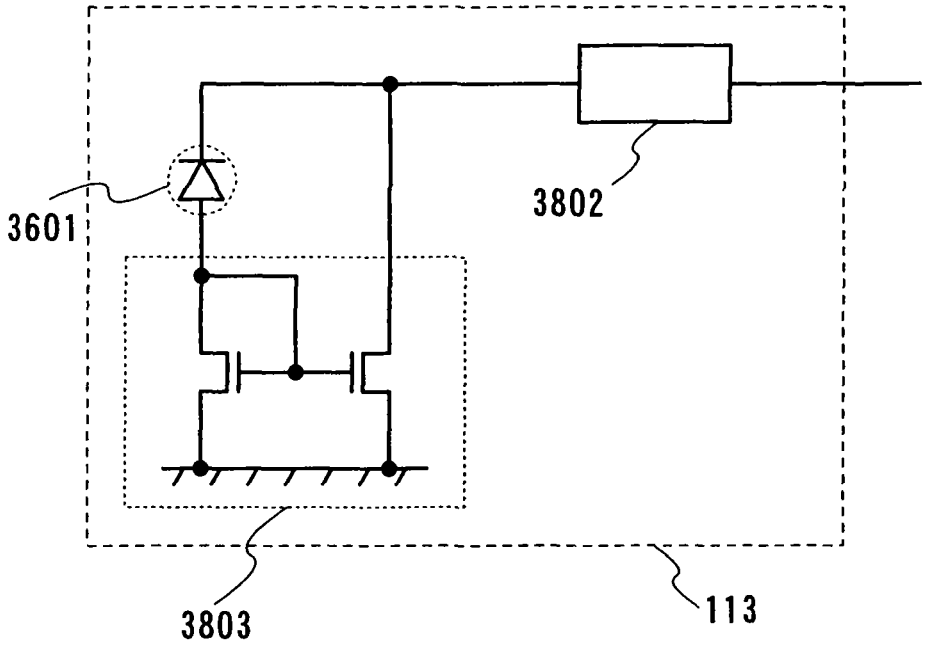
FIG. 33 is a diagram showing a structure of a display device of the invention.

Further, as shown in FIG. 33, all the current flowing to the photoelectric converter 3601 and a current mirror circuit 3803 may be flowed to a current-voltage converter circuit 3802, so that sensitivity to light improves more and resistance properties for noise is improved. Moreover, in this manner, the number of connecting terminals can be reduced since an output of the photoelectric converter 3601 and an output of a current mirror circuit can be set one.

Note that a content described in this embodiment mode can be implemented by freely combining with the content described in Embodiment Modes 1 to 9.

(Embodiment Mode 10)

A structure of a display device related to the invention is described. A display portion of the display device has a plurality of source signal lines, a plurality of gate signal lines which are provided in order to intersect the plurality of source signal lines, and a pixel provided at each intersection of the plurality of source signal lines and the plurality of gate signal lines. This embodiment mode shows an example of a pixel of a liquid crystal display device using liquid crystal.

Figure 36:
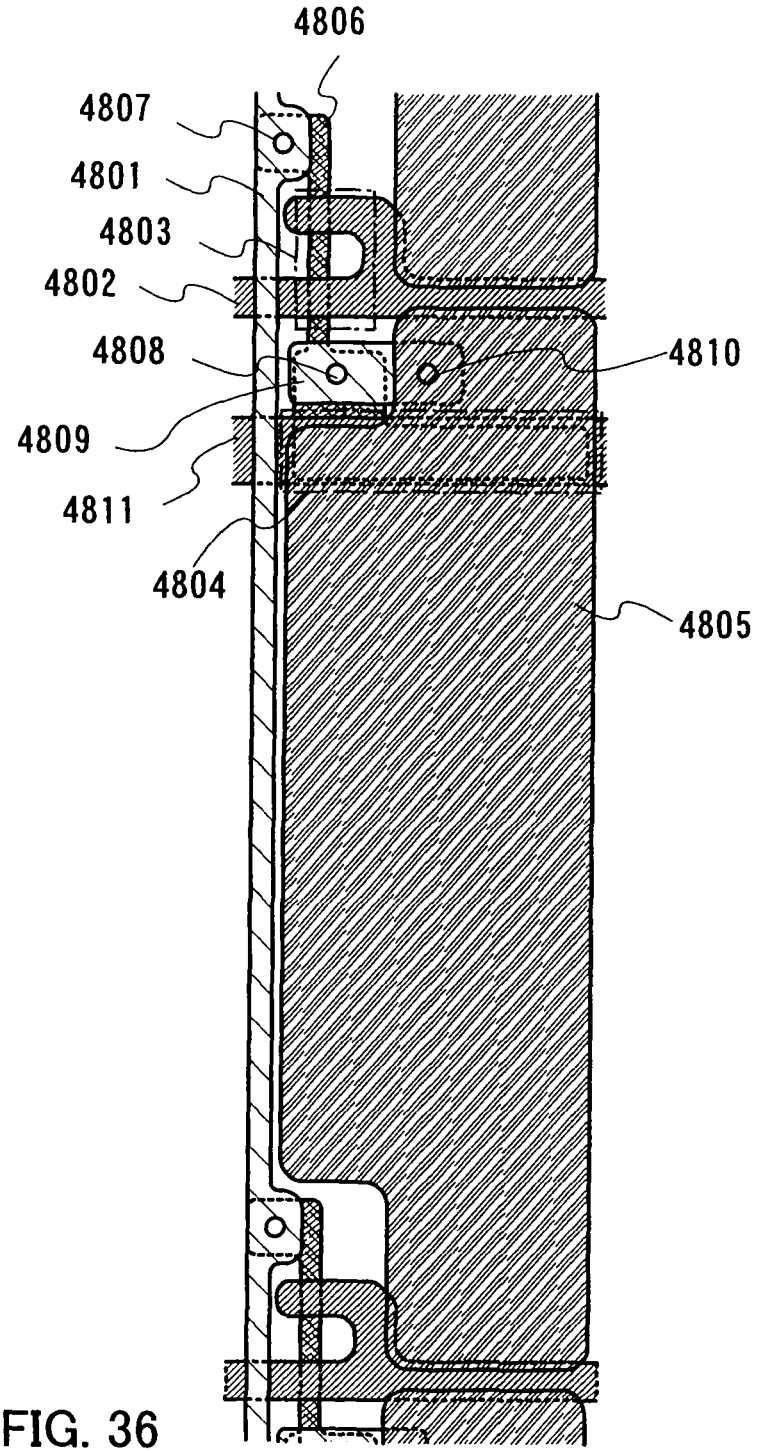
FIG. 36 is a diagram showing a pixel of a display device of the invention.

FIG. 36 shows a configuration of one pixel. A pixel is provided at an intersection of a source signal line 4801 and a gate signal line 4802, and has a transistor 4803, a capacitor 4804, and a liquid crystal element. Note that only one electrode (a pixel electrode 4805) of a pair of electrodes for driving liquid crystal of the liquid crystal element is shown in the diagram.

The transistor 4803 is composed of a semiconductor layer 4806, a first insulating layer, and one portion of the gate signal line 4802 overlapping the semiconductor layer 4806 with the first insulating layer interposed therebetween. The semiconductor layer 4806 becomes an active layer of the transistor 4803. The first insulating layer functions as a gate insulating layer of the transistor. One of a source and a drain of the transistor 4803 is connected to the source signal line 4801 with a contact hole 4807, and the other thereof is connected to a connection wire 4809 with a contact hole 4808. The connection wire 4809 is connected to the pixel electrode 4805 with a contact hole 4810. The connection wire 4809 can be formed using the same conductive layer as that of the source signal line 4801 and etched at the same time.

The capacitor 4804 can be set a capacitor (called a first capacitor) in which the semiconductor layer 4806 and a capacitor wire 4811 overlapping the semiconductor layer 4806 with the first insulating layer interposed therebetween are set as a pair of electrodes, and in which the first insulating layer set as a dielectric layer. Note that further, the capacitor 4804 may have a structure having a capacitor (called a second capacitor) in which the capacitor wire 4811 and the pixel electrode 4805 overlapping the capacitor wire 4811 with a second insulating layer interposed therebetween are set as a pair of electrodes, and in which the second insulating layer is set as a dielectric layer. Since the second capacitor is connected to the first capacitor in parallel, capacitance value of the capacitor 4804 can be increased by providing the second capacitor. Moreover, the capacitor wire 4811 can be formed by using the same conductive layer as that of the gate signal line 4802 and etched at the same time.

The semiconductor layer 4806 is preferably formed of silicon or a crystalline semiconductor containing silicon. For example, polycrystalline silicon in which a silicon thin film is crystallized by laser annealing or the like, single crystalline silicon, or the like is applied. In addition, a metal-oxide semiconductor showing a semiconductor property, amorphous silicon, or an organic semiconductor can be applied as a material for forming the semiconductor layer 4806.

A patterning method of the semiconductor layer 4806 is described. A semiconductor layer is formed on the entire surface of a substrate having an insulating surface or one portion thereof. Then, a mask pattern is formed on the semiconductor layer by a photolithography technique. The etching is performed to the semiconductor layer using the mask pattern, so that the semiconductor layer 4806 is patterned to be formed.

The mask pattern for patterning the semiconductor layer 4806 is formed by using a photomask. The pattern of the photomask has a shape chamfered by a side length of less than or equal to 10 μm in the corner. The mask pattern is formed using this photomask pattern, and the semiconductor layer 4806 is patterned using the mask pattern to be formed; thereby forming a shape in which a corner of a pattern of the semiconductor layer 4806 is chamfered. Note that the corner of the pattern of the semiconductor layer 4806 may be further rounded. That is, by setting an exposure condition and an etching condition appropriately, a pattern shape of the semiconductor layer 4806 may be smoothed more than the photomask pattern. Thus, the semiconductor layer 4806 in which a corner becomes round is formed.

An insulating layer containing at least silicon oxide or silicon nitride in one portion can be used as the first insulating layer.

The gate signal line 4802 and the capacitor wire 4811 are formed by depositing a metal layer or a semiconductor layer with high conductivity by a photolithography technique.

The photomask pattern for forming the gate signal line 4802 and the capacitor wire 4811 has a shape chamfered by a side length of less than or equal to 10 μM in the corner, or by a length of equal to or more than ⅕ but less than or equal to ½ of a wire line width. The mask pattern is formed using this photomask pattern, and the gate signal line 4802 and the capacitor wire 4811 are patterned using the mask pattern to be formed; thereby forming a shape in which a corner of each pattern of the gate signal line 4802 and the capacitor wire 4811 is chamfered. Note that the corner of each pattern of the gate signal line 4802 and the capacitor wire 4811 may be further rounded. That is, by setting an exposure condition and an etching condition appropriately, the each pattern shape of the gate signal line 4802 and the capacitor wire 4811 may be smoothed more than the photomask pattern. Thus, the gate signal line 4802 and the capacitor wire 4811 in which a corner becomes rounded are formed.

The second insulating layer is formed by using an inorganic insulating material such as silicon oxide, or by using an organic insulating material using polyimide, an acrylic resin, or the like. Note that the second insulating layer may be a stack structure of an insulating layer using the material and an insulating layer of silicon nitride, silicon nitride oxide, or the like. The insulating layer of silicon nitride, silicon nitride oxide, or the like can prevent a semiconductor layer and a gate insulating layer from being contaminated by an impurity such as metal ion or moisture, which is not preferable for a transistor.

The source signal line 4801 and the connection wire 4809 are formed of a single layer of metal or a metal compound, or a plurality of the layers.

The photomask pattern for forming the source signal line 4801 and the connection wire 4809 has a shape chamfered by a side length of less than or equal to 10 μm in the corner, or by a length of equal to or more than ⅕ but less than or equal to ½ of a wire line width. A mask pattern is formed by using this photomask pattern, and the source signal line 4801 and the connection wire 4809 are patterned using the mask pattern; thereby forming a shape in which a corner of each pattern of the source signal line 4801 and the connection wire 4809 is chamfered. Note that the corner of each pattern of the source signal line 4801 and the connection wire 4809 may be further rounded. That is, by setting an exposure condition and an etching condition appropriately, an each pattern shape of the source signal line 4801 and the connection wire 4809 may be smoothed more than a photomask pattern. Thus, the source signal line 4801 and the connection wire 4809 in which a corner thereof becomes rounded are formed.

The pixel electrode 4805 is formed of a conductive material of light-transmissivity or a conductive material of non-light transmissivity such as a metal.

A mask pattern is formed on an entire surface of the conductive layer formed of the aforementioned conductive material by a photolithography technique, and an etching is performed by using the mask pattern so that the pixel electrode 4805 having a predetermined pattern is formed. A photomask pattern for forming the pixel electrode 4805 has a shape in which one side in the corner is chamfered by a length of less than or equal to 10 μm. This photomask pattern is used to form a mask pattern, and the mask pattern is used to pattern the pixel electrode 4805. Thus, a corner of the pattern of the pixel electrode 4805 can have a chamfered shape. Note that the corner of the pattern of the pixel electrode 4805 may be further rounded. That is, by setting an exposure condition and an etching condition appropriately, a pattern shape of the pixel electrode 4805 may be smoothed more than the photomask pattern. Thus, the pixel electrode 4805 having a round corner is formed.

When a corner of a bent portion or a portion in which a line width changes is smoothed and rounded in a wire and an electrode, there are following effects. When dry etching using plasma is performed by chamfering a convex portion, generation of fine particle due to discharging can be suppressed. Even if a fine particle is generated, the fine particle is prevented from gathering at the corner at the time of cleaning, and the fine particle can be washed away by chamfering a convex portion. Thus, a problem of fine particles or dust in manufacturing process can be solved and yield can be improved.

Note that the pixel shown in this embodiment mode can be applied to a display device of aforementioned Embodiment Modes 1 to 10.

(Embodiment Mode 11)

The invention can be applied to various electronic apparatuses. Specifically, the invention can be applied to a display portion of an electronic apparatus. As such an electronic apparatus, there are a video camera, a digital camera, a goggle type display, a navigation system, a sound reproducing device (a car audio, an audio component system, and the like), a computer, a game machine, a portable data terminal (a mobile computer, a mobile phone, a portable game machine, an electronic book, or the like), an image reproducing device provided with a recording media (specifically, a device which reproduces a recording media such as a Digital Versatile Disc (DVD) and is provided with a light-emitting device which displays the image), and the like.

Figure 23A:
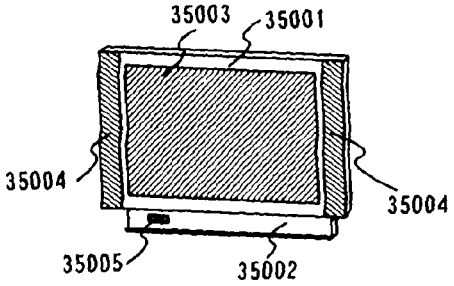
FIGS. 23A to 23H are views each showing an electronic apparatus to which the invention is applied.

FIG. 23A is a light-emitting device including a chassis 35001, a support base 35002, a display portion 35003, speaker portions 35004, a video input terminal 35005, and the like. The display device of the invention can be used as the display portion 35003. Note that the light-emitting device includes all light-emitting devices for information display such as for a personal computer, for a television receiver, and for an advertisement display. The light-emitting device using the display device of the invention for the display portion 35003 can display clear images with high contrast.

Figure 23B:
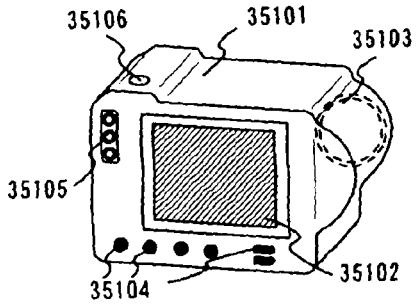

FIG. 23B shows a camera including a main body 35101, a display portion 35102, an image receiving portion 35103, operation keys 35104, an external connecting port 35105, a shutter 35106, and the like.

The digital camera using the invention for the display portion 35102 can display clear images with high contrast.

Figure 23C:
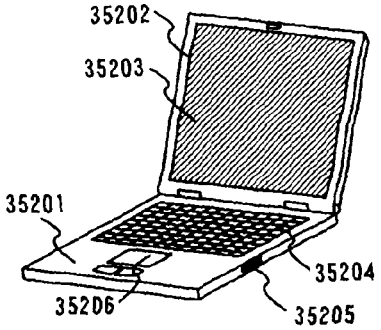

FIG. 23C shows a computer including a main body 35201, a chassis 35202, a display portion 35203, a keyboard 35204, an external connecting port 35205, a pointing mouse 35206, and the like. The computer using the invention for the display portion 35203 can display clear images with high contrast.

Figure 23D:
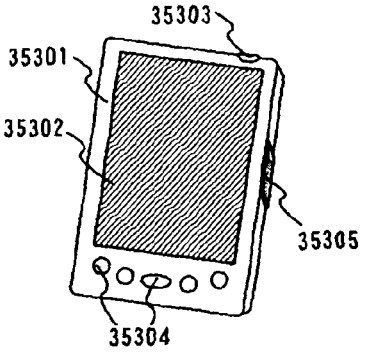

FIG. 23D shows a mobile computer including a main body 35301, a display portion 35302, a switch 35303, operation keys 35304, an infrared port 35305, and the like. The mobile computer using the invention for the display portion 35302 can display clear images with high contrast.

Figure 23E:
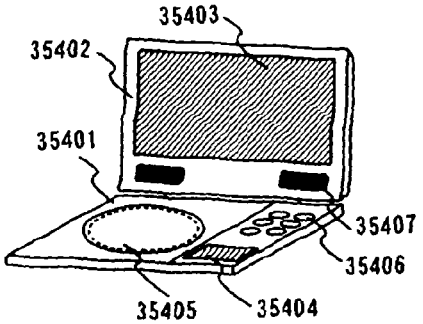

FIG. 23E shows a portable image reproducing device provided with a recording media (specifically, a DVD reproducing device) including a main body 35401, a chassis 35402, a display portion A 35403, a display portion B 35404, a recording media (DVD and the like) reading portion 35405, an operation key 35406, a speaker portion 35407, and the like. The display portion A 35403 can mainly display image data while the display portion B 35404 can mainly display text data. The image reproducing device using the invention for the display portion A 35403 and the display portion B 35404 can display clear images with high contrast.

Figure 23F:
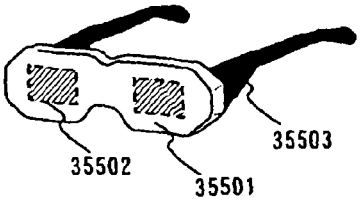

FIG. 23F shows a goggle type display including a main body 35501, a display portion 35502, and an arm portion 35503. The goggle type display using the invention for the display portion 35502 can display clear images with high contrast.

Figure 23G:
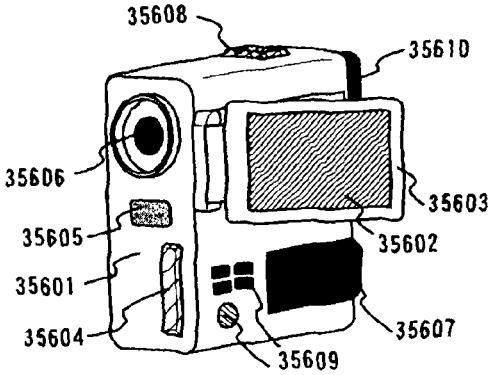

FIG. 23G shows a video camera including a main body 35601, a display portion 35602, a chassis 35603, an external connecting port 35604, a remote control receiving portion 35605, an image receiving portion 35606, a battery 35607, a sound input portion 35608, operation keys 35609, an eyepiece portion 35610, and the like. The video camera using the invention for the display portion 35602 can display clear images with high contrast.

Figure 23H:
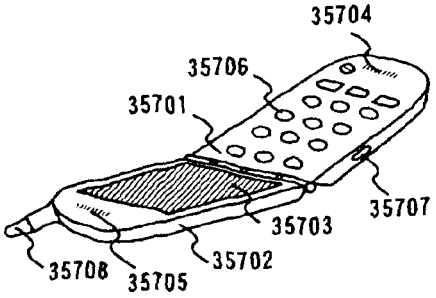

FIG. 23H shows a mobile phone including a main body 35701, a chassis 35702, a display portion 35703, a sound input portion 35704, a sound output portion 35705, an operation key 35706, an external connecting port 35707, an antenna 35708, and the like. The mobile phone using the invention for the display portion 35703 can display clear images with high contrast.

As set forth above, the applicable range of the invention is extremely wide; therefore, the invention can be used as electronic apparatuses in various fields. In addition, the electronic apparatuses described in this embodiment mode can use any configuration of the display devices described in Embodiment Modes 1 to 10.

This application is based on Japanese Patent Application serial no. 2005-148832 filed in Japan Patent Office on May 20, 2005, the entire contents of which are hereby incorporated by reference.

What is claimed is:

1. A liquid crystal display device comprising:

a plurality of pixels provided in matrix, each of which comprises a liquid crystal element;

a gate driver for supplying gate signals to the plurality of pixels;

a source driver for supplying any one of analog video signals and digital video signals to the plurality of pixels;

an optical sensor;

a display mode-specific video signal generation circuit operationally connected to the optical sensor, the display mode-specific video signal generation circuit comprising a first switch, a second switch, a third switch, and a level conversion circuit, and a first line to a n-th line each electrically connected to the display mode-specific video signal generation circuit, wherein n is a natural number, wherein the second switch and the third switch are each electrically connected to the level conversion circuit, wherein the second switch is electrically connected to the n-th line, wherein the first switch is capable of turning on so that the display mode-specific video signal generation circuit supplies the analog video signals to the source driver in a first display mode, wherein the second switch and the third switch are capable of turning on so that the display mode-specific video signal generation circuit supplies the digital video signals to the source driver in a second display mode, and wherein the first display mode and the second display mode are switched according to an external light intensity.

2. The liquid crystal display device according to claim 1, wherein the display mode-specific video signal generation circuit comprises a DA converter.

3. The liquid crystal display device according to claim 1, wherein the digital video signals are binary signals.

4. The liquid crystal display device according to claim 1, wherein the digital video signals are multiple-valued signals.

5. An electronic apparatus comprising the liquid crystal display device according to claim 1.

6. A liquid crystal display device comprising:

a plurality of pixels provided in matrix, each of which comprises a liquid crystal element and a transistor, wherein the transistor comprises a semiconductor layer;

a gate driver for supplying gate signals to the plurality of pixels;

a source driver for supplying any one of analog video signals and digital video signals to the plurality of pixels;

an optical sensor;

a display mode-specific video signal generation circuit operationally connected to the optical sensor, the display mode-specific video signal generation circuit comprising a first switch, a second switch, a third switch, and a level conversion circuit, and a first line to a n-th line each electrically connected to the display mode-specific video signal generation circuit, wherein n is a natural number, wherein the second switch and the third switch are each electrically connected to the level conversion circuit, wherein the second switch is electrically connected to the n-th line, wherein the first switch is capable of turning on so that the display mode-specific video signal generation circuit supplies the analog video signals to the source driver in a first display mode, wherein the second switch and the third switch are capable of turning on so that the display mode-specific video signal generation circuit supplies the digital video signals to the source driver in a second display mode, and wherein the first display mode and the second display mode are switched according to an external light intensity.

7. The liquid crystal display device according to claim 6, wherein the display mode-specific video signal generation circuit comprises a DA converter.

8. The liquid crystal display device according to claim 6, wherein the digital video signals are binary signals.

9. The liquid crystal display device according to claim 6, wherein the digital video signals are multiple-valued signals.

10. An electronic apparatus comprising the liquid crystal display device according to claim 6.

11. The liquid crystal display device according to claim 6, wherein the semiconductor layer comprises a metal-oxide semiconductor.

12. The liquid crystal display device according to claim 6, wherein the semiconductor layer comprises ZnO or InGaZnO.

* * * * *